US007052315B2

(12) United States Patent
Murr et al.

(10) Patent No.: US 7,052,315 B2
(45) Date of Patent: May 30, 2006

(54) STACKED JACK ASSEMBLY PROVIDING MULTIPLE CONFIGURATIONS

(75) Inventors: Keith M Murr, Etters, PA (US); Nancy L Reeser, Mechanicsburg, PA (US); Michael E Shirk, Grantville, PA (US); Michael W Fogg, Harrisburg, PA (US); Michael F Cina, Elizabethtown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 50 days.

(21) Appl. No.: 10/868,986

(22) Filed: Jun. 16, 2004

(65) Prior Publication Data

US 2005/0282432 A1 Dec. 22, 2005

(51) Int. Cl.
*H01R 13/60* (2006.01)

(52) U.S. Cl. ..... 439/540.1; 439/541.5

(58) Field of Classification Search ..... 439/540.1, 439/545.1

See application file for complete search history.

(56) References Cited

U.S. PATENT DOCUMENTS

| | | | | |
|---|---|---|---|---|
| 5,531,612 | A | 7/1996 | Goodall et al. | |
| 5,647,767 | A * | 7/1997 | Scheer et al. | 439/620 |
| 6,080,011 | A | 6/2000 | Tsao et al. | 439/541.5 |
| 6,227,911 | B1 | 5/2001 | Boutros et al. | |
| 6,450,837 | B1 | 9/2002 | Givens et al. | 439/620 |
| 6,655,988 | B1 | 12/2003 | Simmons et al. | |
| 6,663,437 | B1 | 12/2003 | Korsunsky et al. | 439/676 |
| 6,764,343 | B1 | 7/2004 | Ferentz | 439/620 |

* cited by examiner

*Primary Examiner*—Briggitte R. Hammond

(57) ABSTRACT

A stacked jack multi-port shielded and magnetically conditioned connector assembly is provided for assembly in three distinct configurations. One configuration is where power over ethernet is not required, but rather modular jack contacts are directly connected to a motherboard. A second configuration, the connector assembly can be configured to be enabled to receive conditioned and controlled electrical signals to the connector, whereby power over ethernet may be provided through designated ones of the modular jack contacts. Alternatively, the connector can be configured for an integrated power over ethernet card, where the device is provided as an integrated assembly.

9 Claims, 26 Drawing Sheets

STACKED JACK ASSEMBLY PROVIDING MULTIPLE CONFIGURATIONS

FIELD OF THE INVENTION

The invention relates to a connector assembly for use with an electrical connector which can accommodate multiple configurations, and can include power over ethernet.

BACKGROUND OF THE INVENTION

It is desirable in today's marketplace, given the building infrastructure, to provide power over ethernet cable, thus providing power directly to a modular jack interface. A common modular jack interface is the so-called RJ-45 modular jack, which provides eight or more contacts, and which mates with a like modular plug.

Thus, providing power through the ethernet cable (otherwise referred to as Power-Over-Ethernet or POE) allows some power to be delivered at an ethernet interface, where power is not otherwise available. It is known to provide approximately 16 watts through ethernet cable, whereby the power is available as a DC source at the ethernet interface. This could be used as a power source for phone usage, or to trickle charge batteries such as cell phone or laptop batteries. In this case, however, power over ethernet control cards are provided, whereby the power is controlled and conditioned to the interface of the ethernet connection.

One way of accomplishing this task is to provide a connector device on a motherboard, which receives a power over ethernet control card, which thereafter is connected to a further electrical connector device having the interface. In such cases, valuable real estate is taken up on the motherboard and also further complicates both the motherboard patterns as well as requires redundant connection devices.

Moreover, from a connector-manufacturing standpoint, it is desirable to provide as many options as possible to the user and yet not require multiple and/or redundant component parts.

One multi-port electrical connector is shown in U.S. Pat. No. 6,655,988 and assigned to the present assignee, and is incorporated in its entirety herein.

Thus, the objects of the invention are to provide a connection system consistent with the needs described above.

The objects of the invention have been accomplished by providing a universal multi-port jack assembly, comprising a multi-port electrical connector housing having a plurality of housing ports adjacent a mating face of the connector housing. A plurality of electrical connection devices are positioned with first mating contact portions adjacent the mating face, and are adapted for mating engagement with a plurality of electrical connectors in the housing ports. A plurality of second mating contact portions extend rearwardly in a common patterned configuration. A main board is positioned adjacent to a rear of the connector housing and has a first common electrical interface, being electrically interconnected to the second mating contact portions. The main board further comprises a second common electrical interface being electrically connectable with a third common electrical interface on a motherboard. The main board has any one of a plurality of configurations, wherein the plurality of configurations include:

a first configuration wherein the main board is circuit traces only, the main board functioning to electrically interconnect the plurality of electrical connection devices to the mother board through a first designated subset of the second and third common electrical interface;

a second configuration wherein the main board has circuit traces for electrically interconnecting the plurality of electrical connection devices to the mother board through a first designated subset of the second and third common electrical interface, and the main board is enabled to receive conditioned electrical power signals for power over ethernet through a second designated subset of the second and third common electrical interface; and a third configuration wherein the main board has circuit traces for electrically interconnecting the plurality of electrical connection devices to the mother board through a first designated subset of the second and third common electrical interface, and the main board further comprises an electrical connector interconnected to the main board, and wherein a further power over ethernet conditioning board may be connectable directly therewith, whereby the main board is adapted to receive unconditioned electrical power signals for power over ethernet through a second designated subset of the second and third common electrical interface, and route them through the further power over ethernet conditioning board, and then through the first mating contact portions.

The second common electrical interface may be comprised of edge contacts on the main board and a printed circuit board edge card connector interconnected thereto, the edge card connector having edge card printed circuit board contacts which are configured to match the third common electrical interface on the motherboard. The universal multi-port jack assembly can also include an outer shield in surrounding relation to the assembly wherein the shield has opening ports to access the housing ports, and the edge card printed circuit board contacts extend outside of said shield. The shield may include a knock-out portion overlying the position of the electrical connector, in the case of the third configuration.

The first mating contact portions of the electrical connection devices may be comprised of electrical terminals configured as modular jack terminals, the terminals including reversely bent portions adjacent the housing ports and the electrical terminals being interconnected to a printed circuit card having signal conditioning devices thereon, and the plurality of second mating contact portions of the electrical connection devices are comprised of printed circuit tines interconnected to the printed circuit card and profiled for interconnection with the first common electrical interface. The printed circuit tines may be press fit style contacts.

In another embodiment of the invention, a universal multi-port jack assembly, comprises a multi-port electrical connector housing having a plurality of housing ports adjacent a mating face of the connector housing. A plurality of electrical connection devices are positioned with first mating contact portions adjacent the mating face, and are adapted for mating engagement with a plurality of electrical connectors in the housing ports, and a plurality of second mating contact portions extending rearwardly in a common patterned configuration. A main board is positioned adjacent to a rear of the connector housing and has a first common electrical interface, being electrically interconnected to the second mating contact portions, and the main board further comprising edge contacts adjacent to an edge thereof. A printed circuit board edge card connector is interconnected thereto, the edge card connector having edge card printed circuit board contacts which are configured to the third common electrical interface on agro motherboard. An outer shield is positioned in surrounding relation to the assembly wherein the shield has opening ports to access the housing ports, and the edge card printed circuit board contacts extend outside of the shield.

In a first configuration, the main board comprises circuit traces only, the main board functioning to electrically interconnect the plurality of electrical connection devices to the mother board through a first designated subset of the second and third common electrical interface.

In a second configuration, the main board comprises circuit traces for electrically interconnecting the plurality of electrical connection devices to the mother board through a first designated subset of the second and third common electrical interface, and the main board is enabled to receive conditioned electrical power signals for power over ethernet through a second designated subset of the second and third common electrical interface.

In a third configuration, the main board comprises circuit traces for electrically interconnecting the plurality of electrical connection devices to the mother board through a first designated subset of the second and third common electrical interface, and the main board further comprises a first electrical connector interconnected to the main board, and wherein a further power over ethernet conditioning board may be connectable directly therewith, whereby the main board is adapted to receive unconditioned electrical power signals for power over ethernet through a second designated subset of the second and third common electrical interface, and route them through the further power over ethernet conditioning board, and then through the first mating contact portions.

In the third configuration, the shield may include a knock-out portion overlying the position of the first electrical connector. The main board lies in a vertical plane adjacent a rear of the connector housing. The power over ethernet card has control circuitry thereon, and has a second electrical connector connected to the first electrical connector, with the power over ethernet card lying parallel with the main board. A heat reduction device may be positioned on the power over ethernet card. The heat reduction device may comprises a fan or a heat sink.

The first mating contact portions of the electrical connection devices may be comprised of electrical terminals configured as modular jack terminals, the terminals including reversely bent portions adjacent the housing ports and the electrical terminals being interconnected to a printed circuit card having signal conditioning devices thereon, and the plurality of second mating contact portions of the electrical connection devices are comprised of printed circuit tines interconnected to the printed circuit card and profiled for interconnection with the first common electrical interface. The printed circuit tines may be press fit style contacts.

The universal multi-port jack assembly may also further comprise an indicator member for indicating the condition of the plurality of electrical connection devices. The indicator member may be comprised of light emitting diodes positioned on the main board, with light pipes extending from the diodes to a position adjacent to the housing ports, whereby the light may be seen from a front of the assembly.

In yet another embodiment of the invention, a multi-port jack assembly has integrated power over ethernet, and comprises a multi-port electrical connector housing having a plurality of housing ports adjacent a mating face of the connector housing. A plurality of electrical connection devices are positioned with first mating contact portions adjacent the mating face, and are adapted for mating engagement with a plurality of electrical connectors in the housing ports, and a plurality of second mating contact portions extending rearwardly in a common patterned configuration. A main board is positioned adjacent to a rear of the connector housing and has a first common electrical interface, being electrically interconnected to the second mating contact portions, the main board further comprises a second common electrical interface being electrically connectable with a third common electrical interface on a motherboard. The main board has circuit traces for electrically interconnecting the plurality of electrical connection devices to the mother board through a first designated subset of the second and third common electrical interface, and the main board further comprises an electrical connector interconnected to the main board. A power over ethernet conditioning board is directly connected to the main board, whereby the main board is adapted to receive unconditioned electrical power signals for power over ethernet through a second designated subset of the second and third common electrical interface, and route them through the power over ethernet conditioning board, and then through the first mating contact portions.

The second common electrical interface may be comprised of edge contacts on the main board and a printed circuit board edge card connector interconnected thereto, the edge card connector having edge card printed circuit board contacts which are configured to match the third common electrical interface on the motherboard. The outer shield is in surrounding relation to the assembly of the connector housing, electrical connection devices and main board. The outer shield includes a knock-out portion overlying the position of the electrical connector, and the power over ethernet conditioning board is position outside of the shield and interconnected to the electrical connector.

The main board lies in a vertical plane adjacent a rear of the connector housing, and the power over ethernet card has a second electrical connector connected to the first electrical connector, with the power over ethernet card lying parallel with the main board. A heat reduction device may be positioned on the power over ethernet card, and may be comprised of a heat sink or a fan.

BRIEF DESCRIPTION OF THE DRAWINGS

The invention will now be described by way of reference to the drawings, where.

DETAILED DESCRIPTION OF THE PREFERRED EMBODIMENTS

Figure 1:
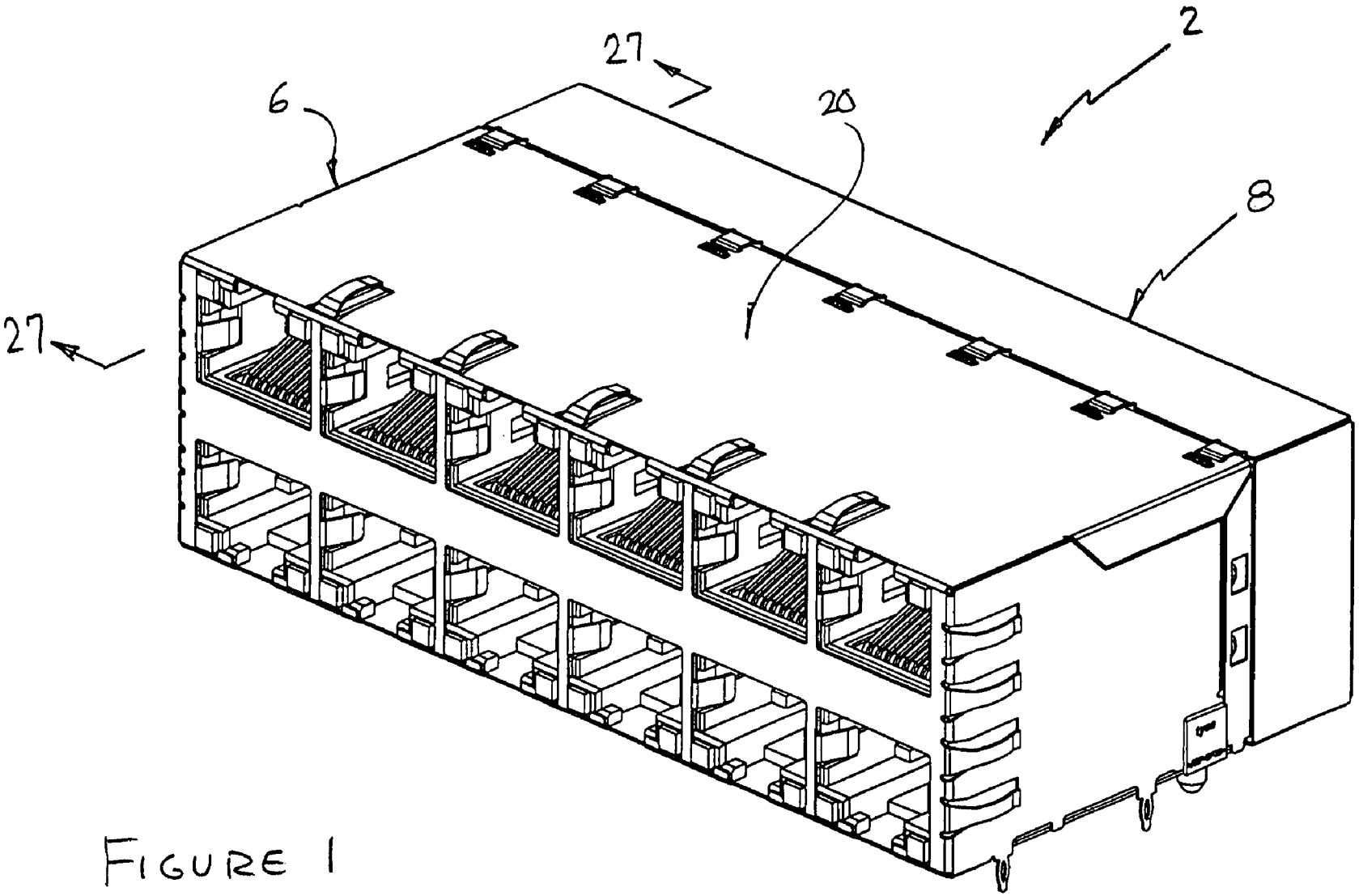
FIG. 1 is a front perspective view of the present invention with an integrated power over ethernet printed circuit board.
Figure 2:
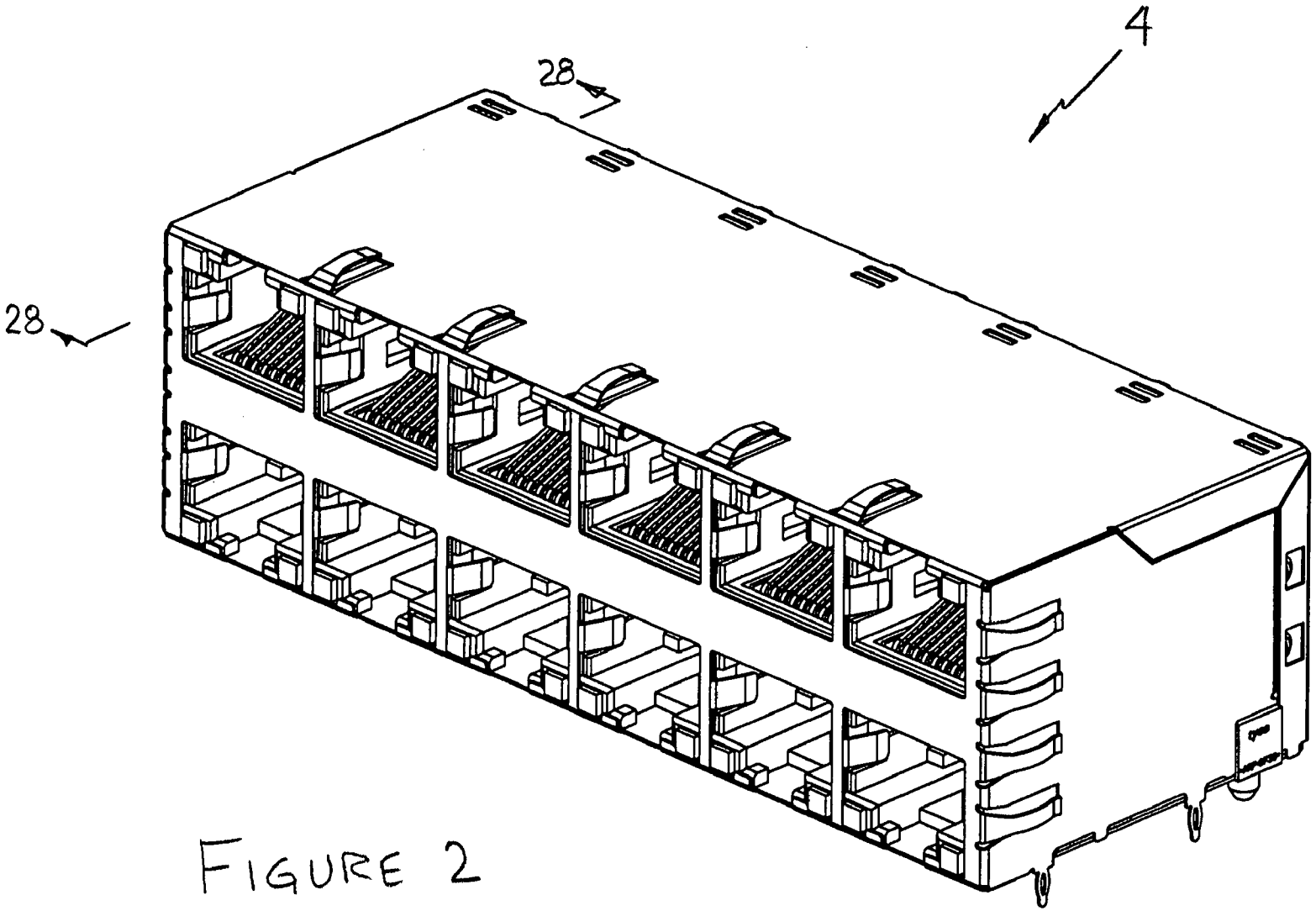
FIG. 2 shows a front perspective view of the invention as configured for stacked modular jacks enabled for external connection of power over ethernet or a stacked modular jack assembly with magnetics only.

With reference first to FIGS. 1 and 2, the summary of the present invention is again reviewed to understand more clearly the invention, and which will make a discussion of the various components of the present invention more clear. As shown in FIG. 1, a multi-port or stacked jack configuration is shown generally at 2, where the connector 2 includes an integrated power over ethernet control card. As shown in FIG. 2, an electrical connector is shown at 4, where connector assembly 4 could take on one of two configurations. First, connector 4 could be an assembly where the power over ethernet control card is not integrated with the connector, but rather is positioned elsewhere on a motherboard and the power signals are routed through a control card on the motherboard, and thereafter to connector 4. Alternatively, connector 4 could be a configuration, where no power over ethernet is required, but is rather a stacked jack assembly with magnetics only. However, in either event, that is, in either the case of the assembly 2 of FIG. 1, or the assembly 4 of FIG. 2, the connector assemblies are designed to use interchangeable components in order to maximize the interchangeability between the component parts and the various assemblies.

Continuing further and still with the general description of the components, FIG. 1 shows connector assembly 2 generally including a shielded stacked jack subassembly 6, having a rearwardly mounted power over ethernet assembly shown generally at 8. It should be appreciated, and will be more clearly pronounced herein, that shielded subassembly 6 is similar to shielded assembly 4 shown in FIG. 2 but for the power over ethernet componentry.

Figure 3:
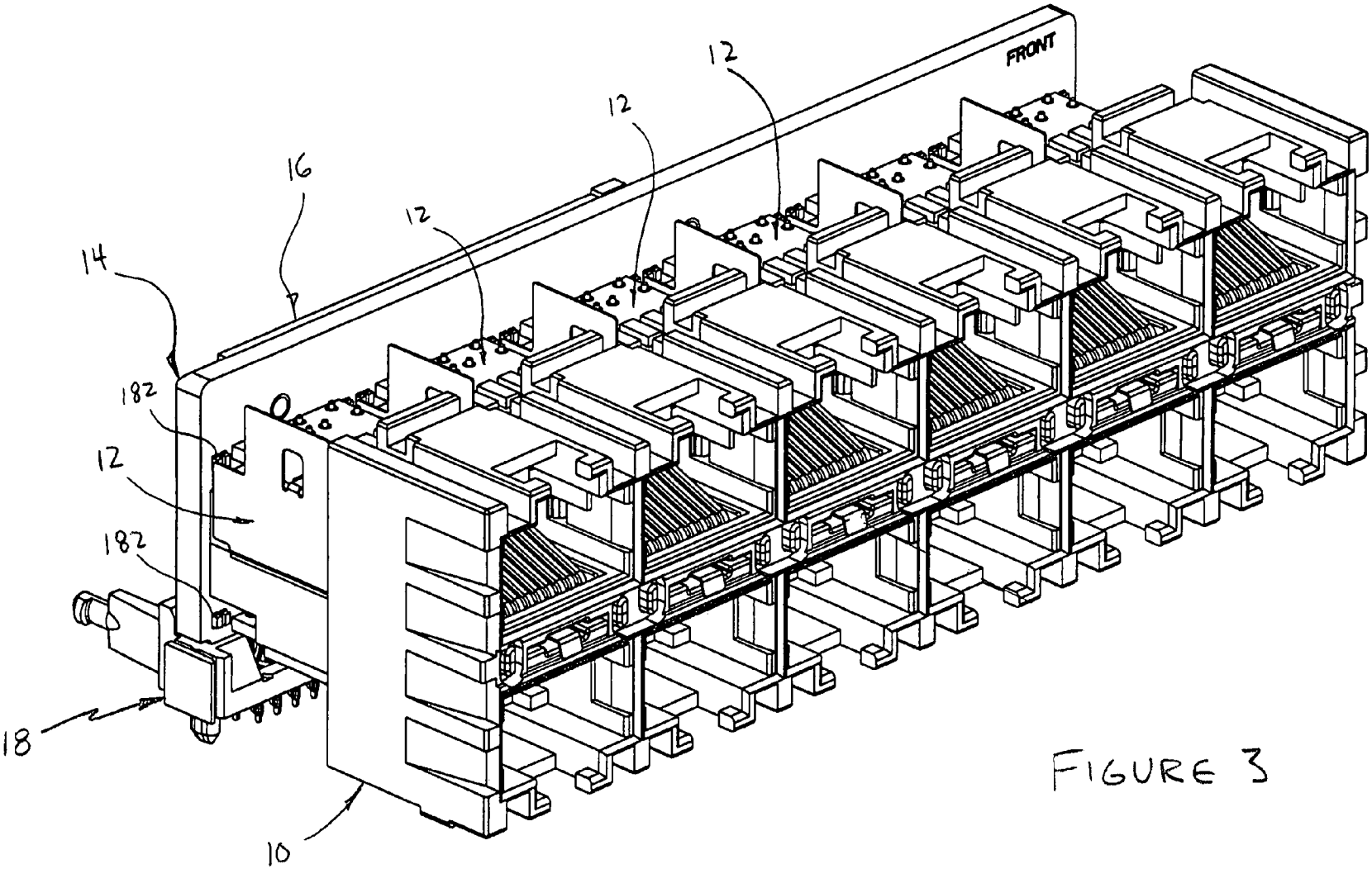
FIG. 3 is a front perspective view of the internal subassembly of the device shown in FIG. 1.
Figure 4:
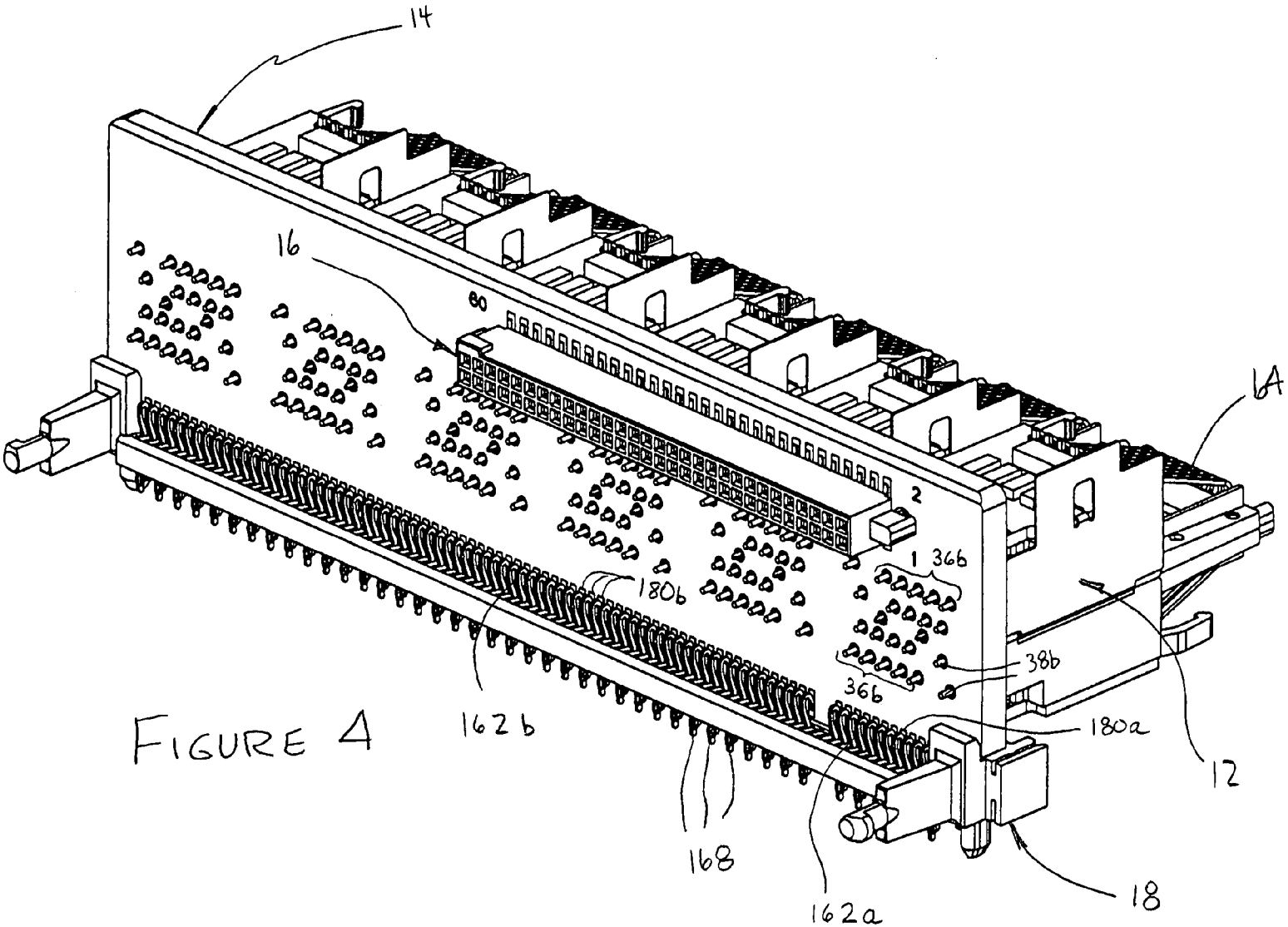
FIG. 4 is a rear perspective view of the device shown in FIG. 3.

Continuing, FIGS. 3 and 4 show the internal structure of shielded subassembly 6 including a front insulative housing assembly 10, a plurality of shielded modular jack subassemblies 12, where the modular jack subassemblies are interconnected to a main board shown at 14. The main board 14 has an electrical connector 16 for interconnection to a power over ethernet module, as described more fully herein, and wherein the main board 14 is interconnectable to an edge card connector 18. It should be appreciated that the entire assembly can be mounted to a motherboard, as will be more fully disclosed herein. It should also be appreciated that the subassembly shown in FIGS. 3 and 4 is the assembly internal to the outer shield 20 of shielded subassembly 6.

Figure 5:
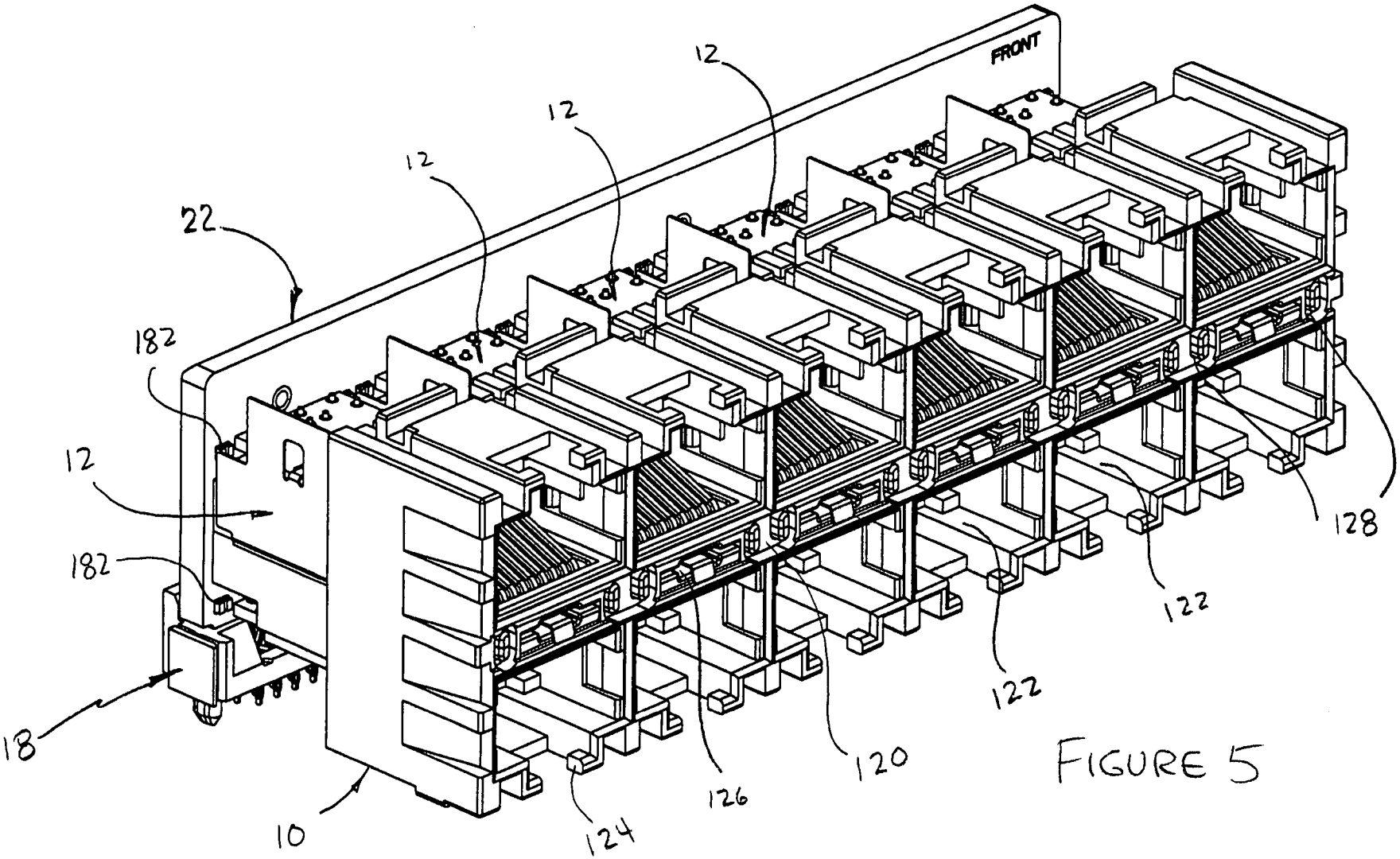
FIG. 5 is a front perspective view of the internal subassembly of the device shown in FIG. 2.
Figure 6:
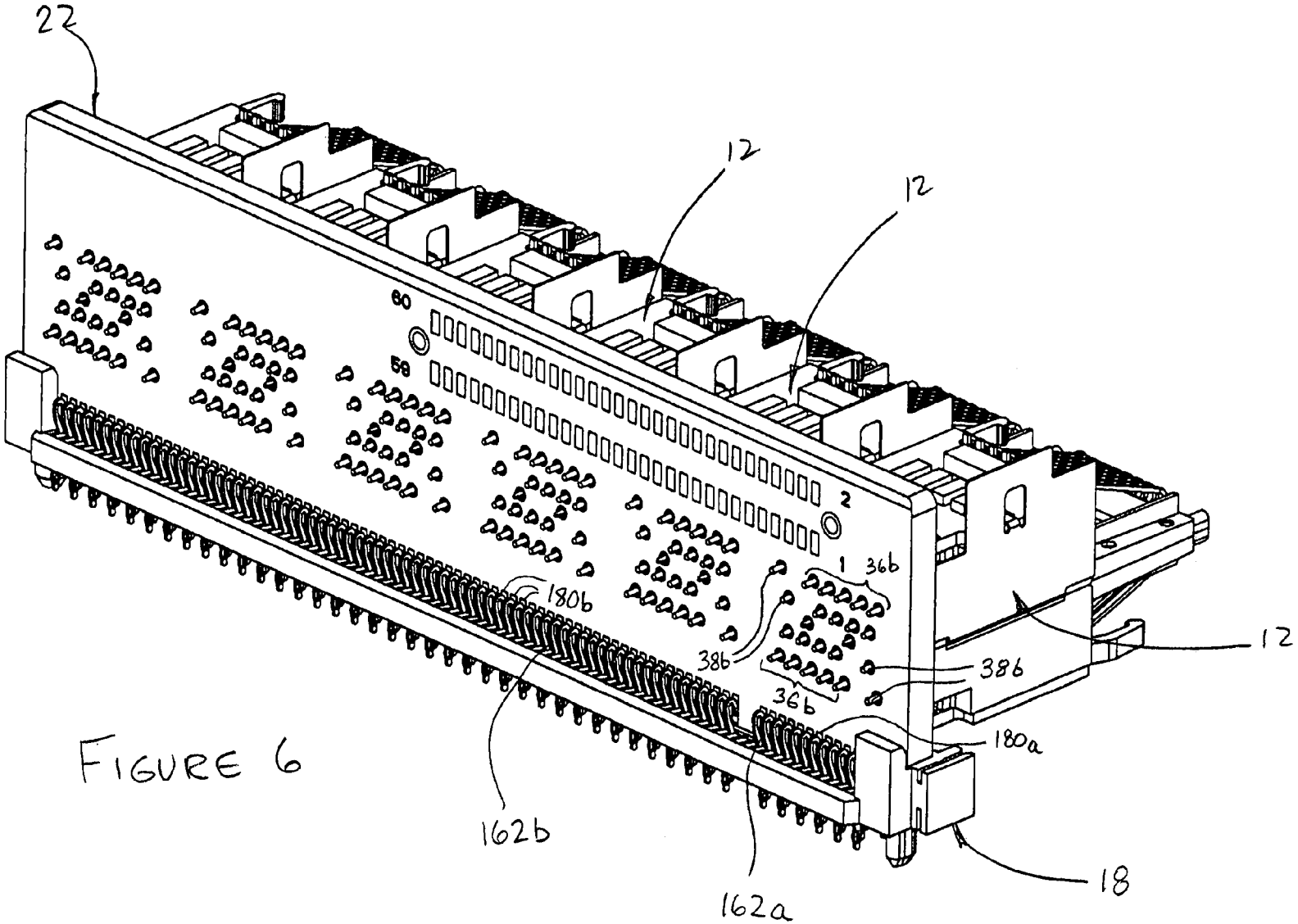
FIG. 6 is a rear perspective view of the subassembly shown in FIG. 5.

With respect now to FIGS. 5 and 6, it will be noticed first that an identical electrical connector housing 10 is utilized, as well as identical shielded modular jack subassemblies 12. A different main board 22 is provided, however, as there is no interconnection directly to a power over ethernet card. Rather, a main board 22 is provided which is interconnected to the plurality of shielded subassemblies 12, as shown best in FIG. 6. An identical edge card connector 18 can be provided, having the identical footprint for interconnection to a like footprint or configuration on a motherboard.

Figure 8:
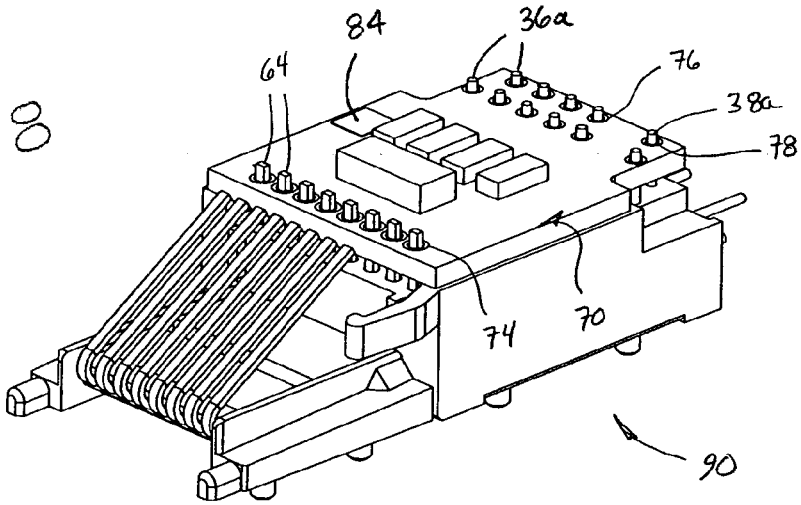
FIG. 8 shows the assembled view of the exploded components of FIG. 7.
Figure 7:
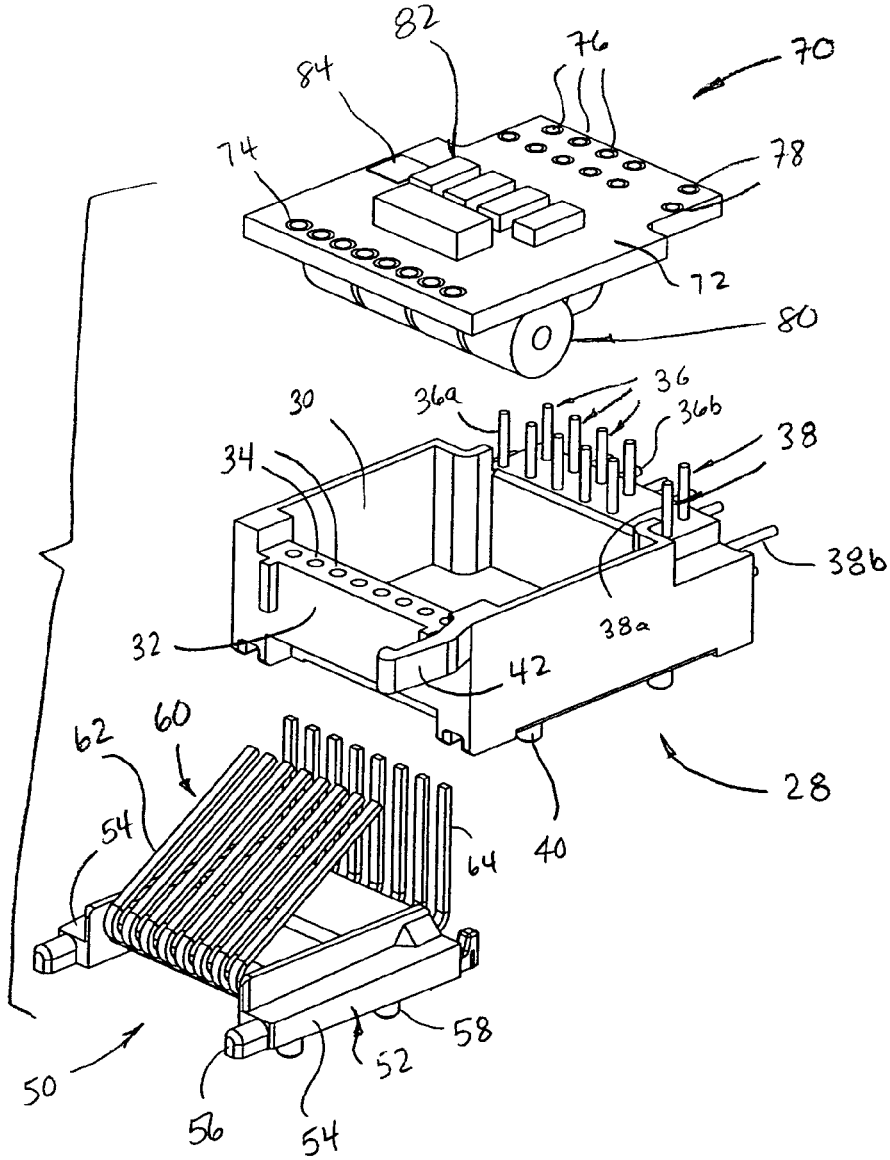
FIG. 7 shows an exploded view of the modular jack subassembly.
Figure 9:
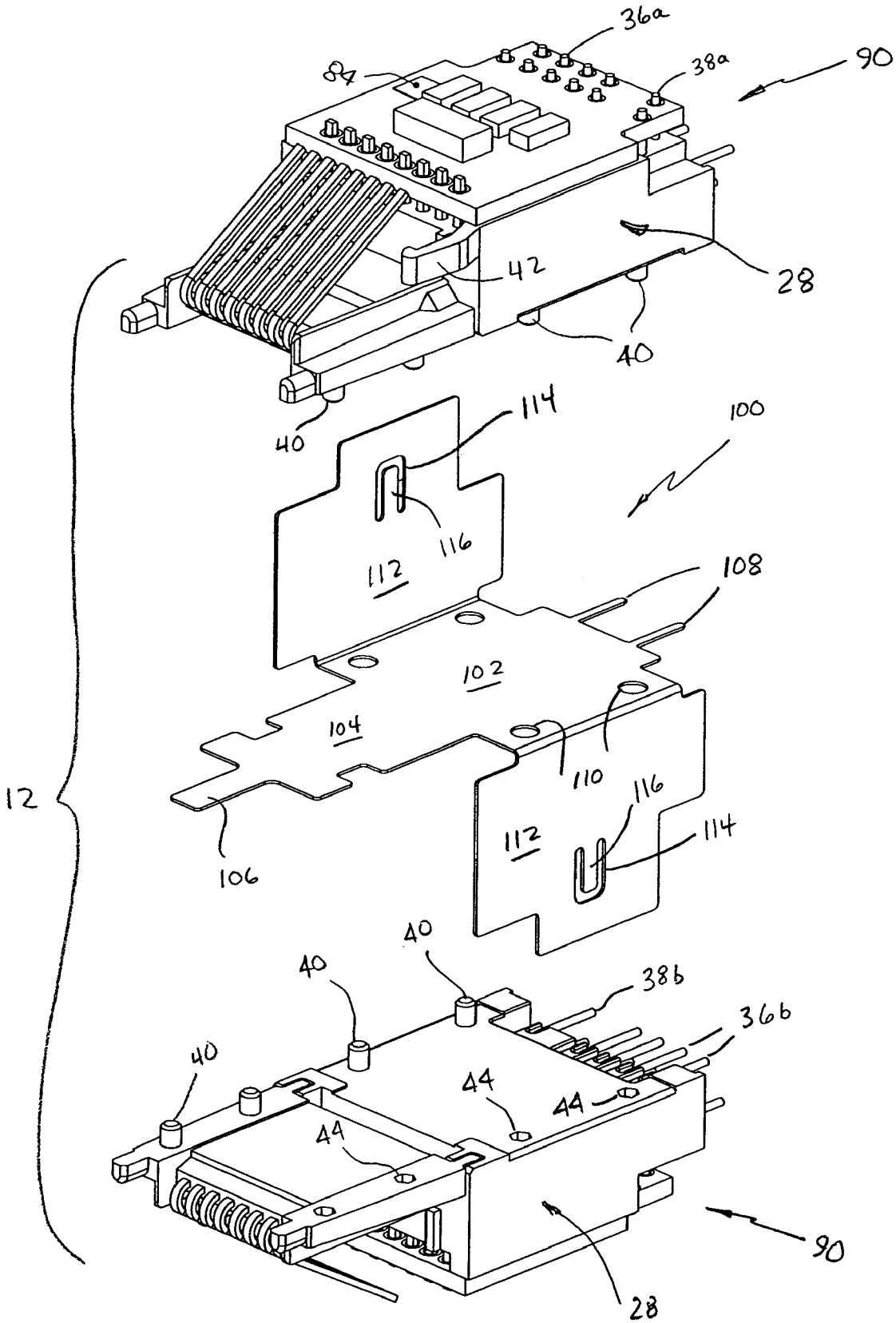
FIG. 9 shows an exploded view of two modular jack halves being interconnected to an intermediate shield.

With reference now to FIGS. 7–9, the shielded subassemblies 12 will be described in greater detail. With respect first to FIG. 7, the shielded modular jack subassemblies 12 have an insulative jack housing 28, having an inner cavity at 30 and a front wall 32, having receiving openings at 34. The housing 28 further includes signal contacts 36 and power contacts at 38, having circuit board portions 36*a*, 36*b* and 38*a*, 38*b*, respectively. Finally, the housing 28 further includes locating lugs 40 on the bottom surface of the housing 28 and a latching arm 42 extending from the front wall 32 thereof. As shown best in FIG. 9, the housings 28 also include hexagonal openings at 44.

The subassembly further includes a jack housing 50, having an insulative housing 52, where the housing includes locating side walls 54, having locating pegs 56 at a front end thereof, and locating lugs 58 on a bottom surface thereof. The jack further includes electrical terminals 60 profiled as modular jack terminals, having reversely bent contact portions at 62 and printed circuit board tines at 64.

As also shown in FIG. 7, the subassembly 12 includes a magnetic package 70 comprised of a printed circuit board 72, having plated throughholes at 74 at a front edge thereof, plated throughholes 76 at a rear edge thereof for signal contacts, and plated throughholes 78 for power contacts. Finally, suppression devices, such as magnetics 80 and/or components 82, are included for suppression-device purposes, as is well known in the art. Finally, the printed circuit board 72 includes a grounding pad at 84 terminated to one of the signal terminals 76 for grounding purposes, as will be described herein.

With respect to FIG. 8, a modular jack subassembly is shown at 90, which is the assembly of components of FIG. 7, and as should be appreciated, printed circuit board tines 64 are positioned through apertures 34 of housing 28 and through throughholes 74 of printed circuit board 70. At the same time, contacts 36*a* project through throughholes 76, while contact portions 38*a* project through apertures 78. Meanwhile, the majority of the suppression devices 80 are positioned within the cavity 30 of housing 28 for a low-profile package. At this point, the contact tines 64, 36*a* and 38*a* may be soldered to their associated plated throughholes 74, 76, 78, respectively.

With respect now to FIG. 9, two such modular jack subassemblies 90 are shown top-to-bottom and disposed on opposite sides of a shield member 100, where shield 100 includes a base plane 102, having a forwardly extending tongue 104, having a grounding tab at 106 and grounding tines 108 extending from the opposite end thereof. Base plate 102 further includes apertures 110. Side wings 112 extend upwardly from one side of the base plate 102 and downwardly from an opposite side edge of the base plate 102 to form upwardly and downwardly extending shield walls, where each of the walls includes a U-shaped cutout portion 114 defining a bendable tab 116. It should be appreciated that the two modular jack subassemblies 90 can be moved towards each other, trapping the shield member therebetween, where pegs 40 align with openings 110 in the shield and with hexagonal openings 44 in the opposite side of the opposite housing 28.

Figure 11:
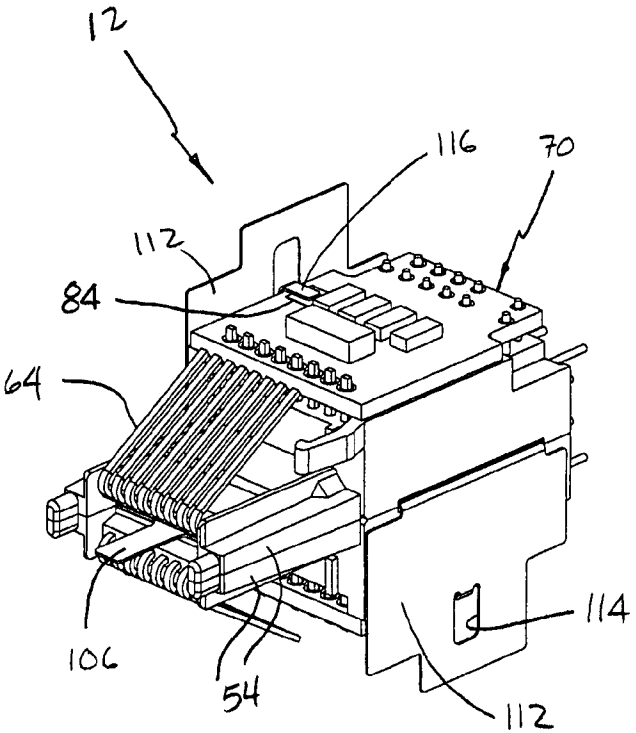
FIG. 11 shows a front perspective view of the assembled modular jack assembly shown in FIG. 10.
Figure 10:
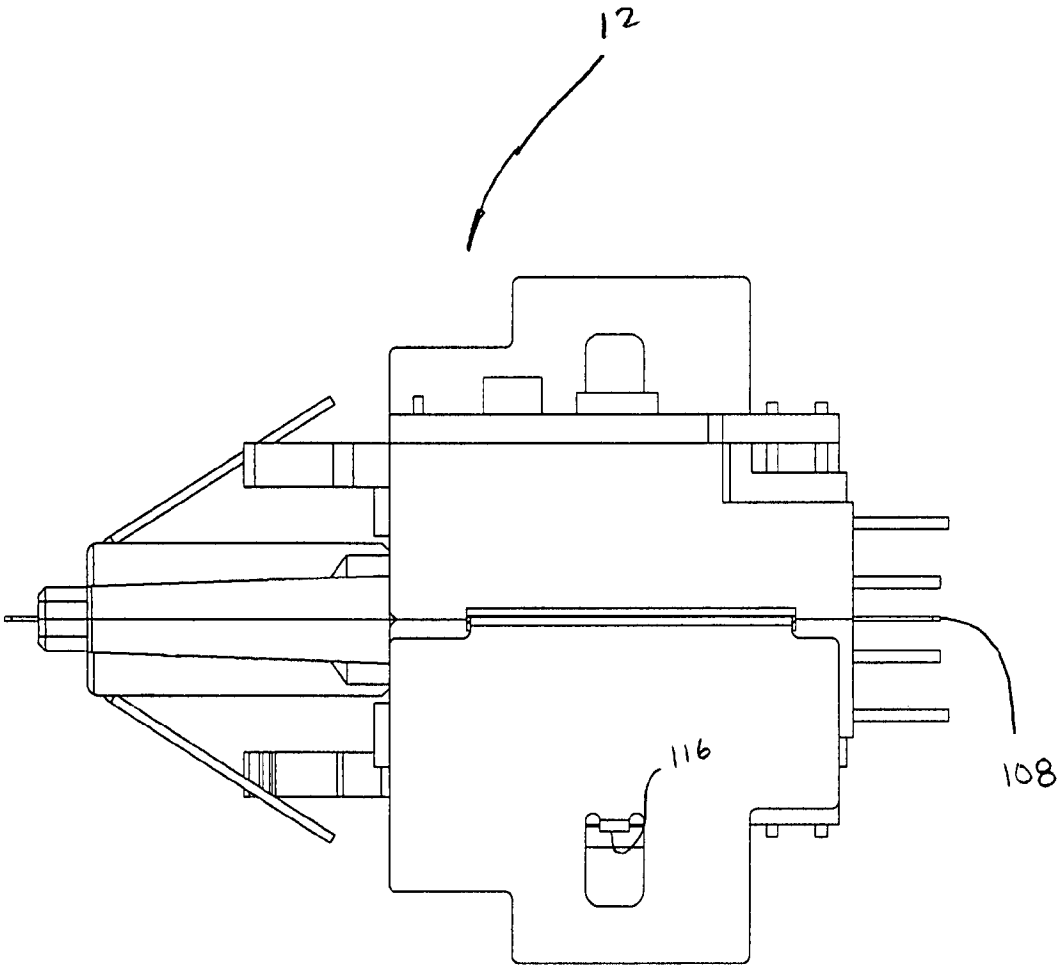
FIG. 10 shows a side view of the assembled components of FIG. 9.

With respect now to FIGS. 10 and 11, the subassembly 12 is completed by bending tabs 116 downwardly over ground pad 84 and can be soldered in place to ground the shields thereto. It should also be appreciated that, from a mechanical standpoint, the two housings 28 can be held together by a frictional press fit between the pegs 40 and apertures 44, or could be held together by any means known, such as ultrasonic welding, adhesives, thermal bonding, or any other known means. However, as defined, and assembled in FIGS. 10 and 11, the subassembly 12 is shown with the modular jack contacts 60 having contact portions 62 positioned in a reversely bent manner towards the front end of the shielded subassembly, with the tab 106 of the ground member 100 extending forwardly therefrom and with ground tines 108 extending rearwardly therefrom.

Figure 12:
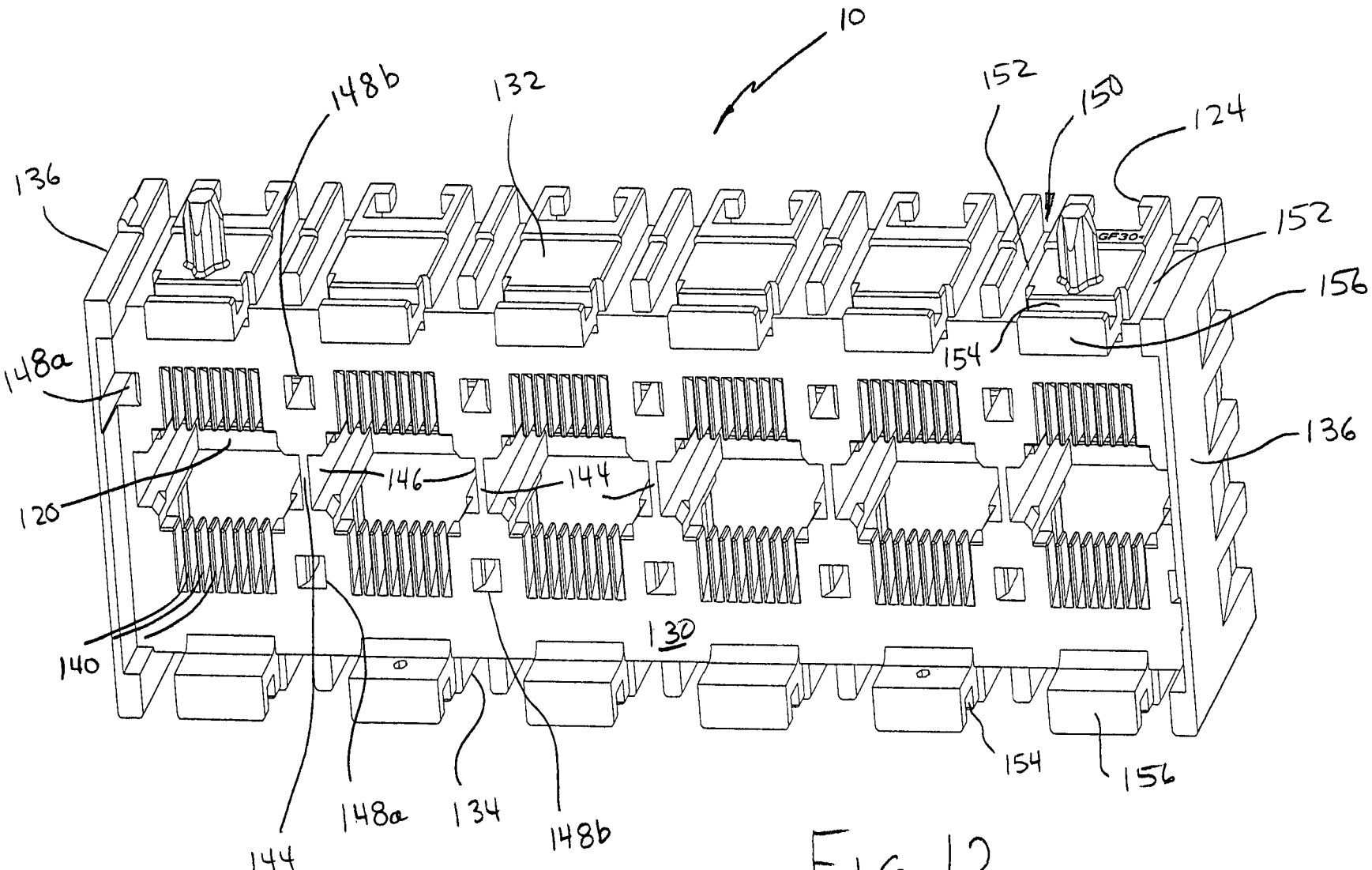
FIG. 12 shows a rear perspective view of the insulative housing for use with either of the devices of FIG. 1 or 2.

With respect now to FIGS. 5 and 12, insulative housing 10 will be described in greater detail. As shown in FIG. 5, housing 10 includes a front mating face 120, defining a plurality of ports 122, where each port includes a latching structure 124 for a well-known modular plug configuration, as is well known in the art. The front mating face 120 also includes a central opening at 126 flanked by two oval-shaped openings at 128. As shown best in FIG. 12, the housing 10 further includes a rear face at 130, top wall 132, bottom wall 134, and side walls 136. Each port 122 includes a set of comb-like members 140, as is also well known in the modular jack art, which defines grooves for receiving the reversely bent contact portions 62 of the modular jacks.

Housing 10 further includes vertical walls 144, which defines vertically stacked pairs of ports 122, where each of the walls includes a locating groove 146, which as should be appreciated, is profiled to receive the pair of side edges 54 (FIG. 11) to align the shielded subassemblies 12 therein. Rear face 130 further includes a plurality of diametrically opposed latching openings, for example, latching openings 148*a* define a pair, 148*b* define a pair, etc., as will be further described herein. Finally, top wall portion 132 includes channels 150 generally defined by axially extending channels 152 flanking the latch portion 124 and a transverse groove portion 154 positioned on extension portions 156.

With respect now to FIGS. 13 and 14, connector 18 will be described in greater detail. Connector 18 is a typical configuration of an edge card connector, having a housing 160 and a plurality of contacts 162. Housing 160 defines a slot 164 for receiving therein an edge card, with contacts 162 defining opposed contacts 166 flanking the opening 164. Terminals 162 further include printed circuit board contact portions 168, and preferably, the contact portions 168 are in the form of a press-fit-style contact with a throughhole of a printed circuit board, and in the embodiment shown, are "eye-of-the-needle"-style contacts. Housing 160 further includes optional rearwardly extending latching arms 170, having a latch member 172. (Optional depending upon whether the power over ethernet board is integrated with the assembly.) Top beams of contacts provide flexibility after solder (or solderless) connection to pads 180*a* or 180*b* on the main board. This provides expansion, contraction and tolerance allowances.

Figures 13, 14:
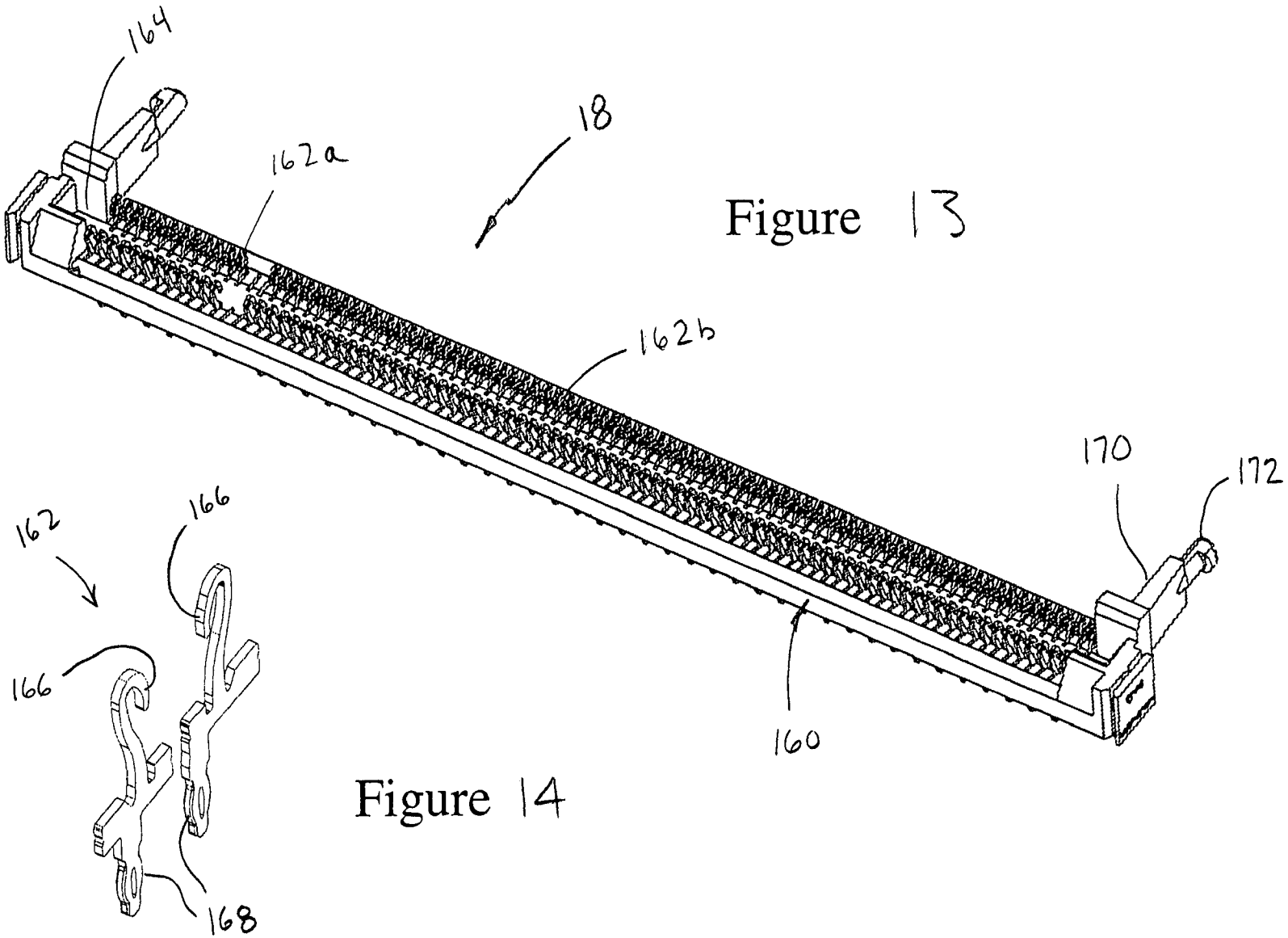
FIG. 13 shows a printed circuit board connector for use for interconnecting one of the main boards to a motherboard.
FIG. 14 shows the electrical contacts used in the connector of FIG. 13.
Figure 15:
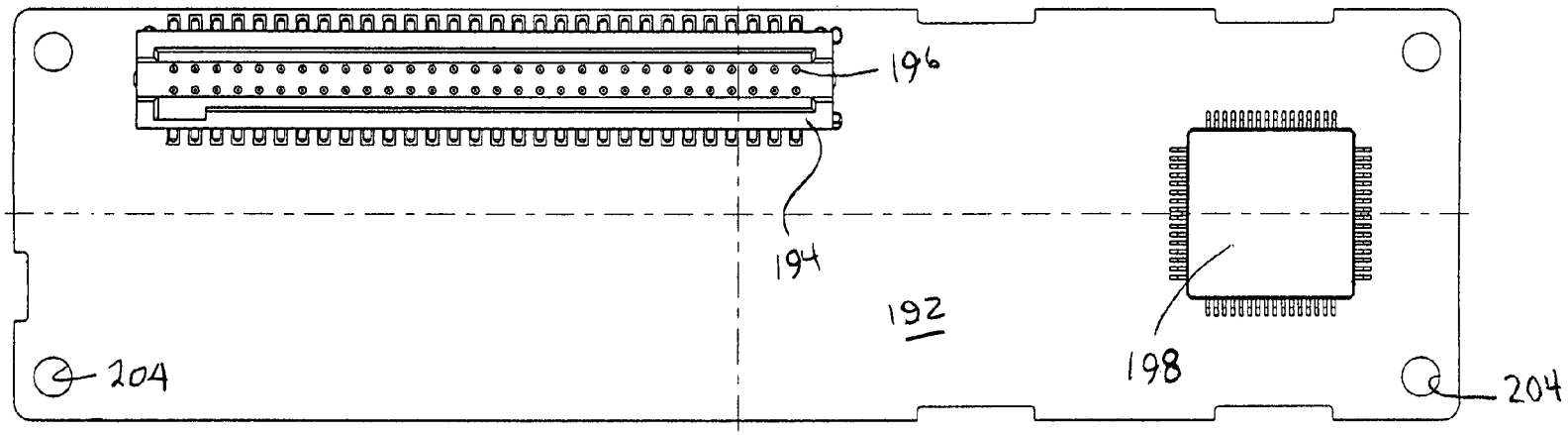
FIG. 15 shows a front plan view of the power over ethernet control card.
Figure 16:
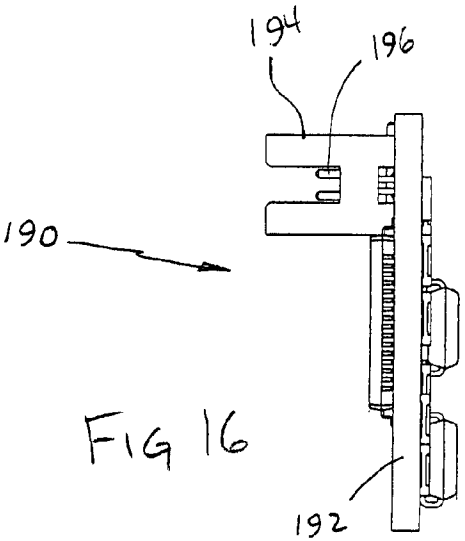
FIG. 16 is an end view of the card shown in FIG. 15.
Figure 18:
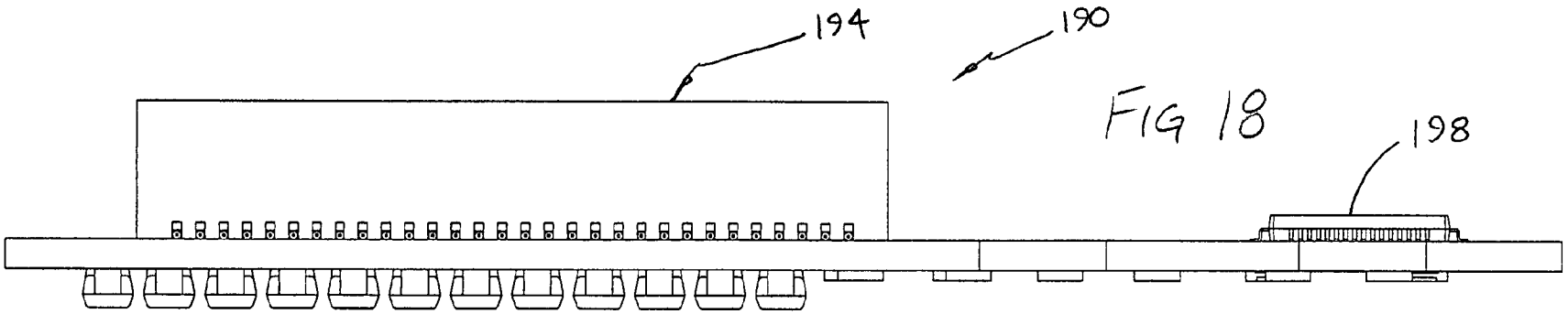
FIG. 18 is a side view of the card shown in FIG. 17.
Figure 17:
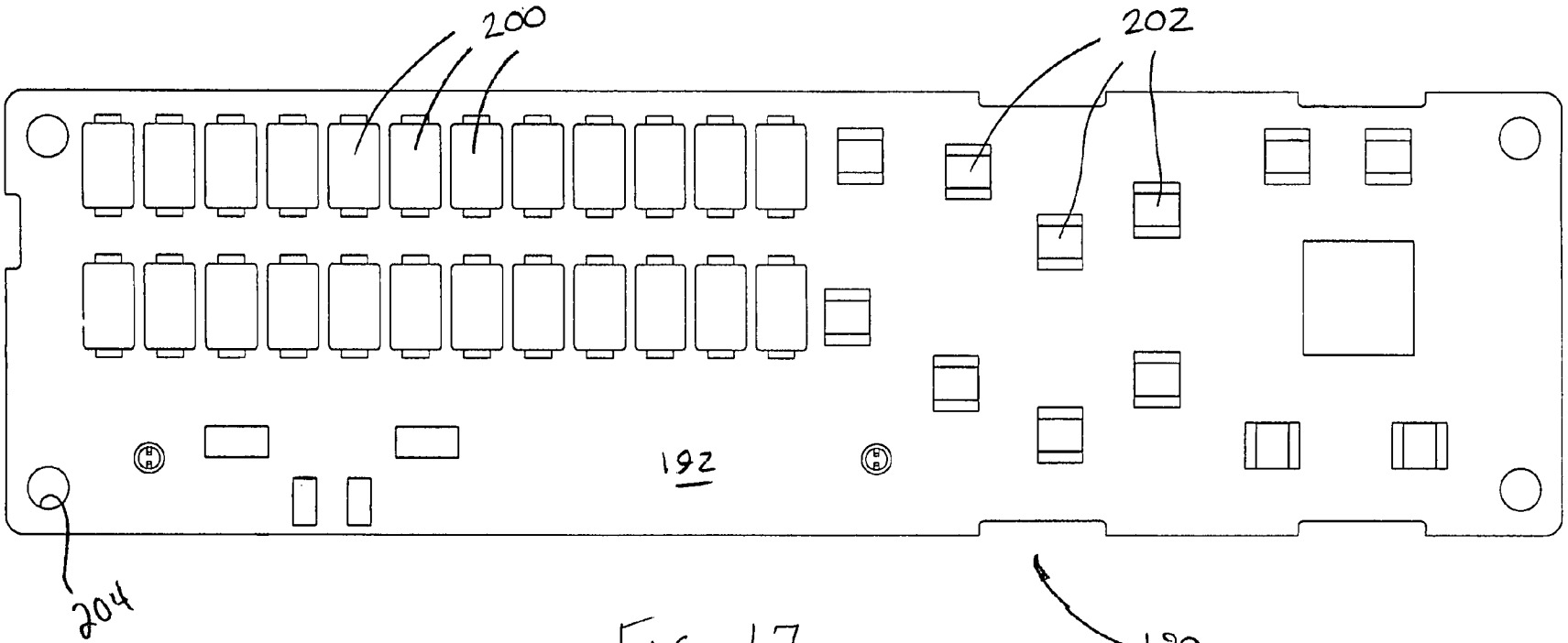
FIG. 17 is a rear plan view of the card shown in FIGS. 15 and 16.

As shown in FIG. 13, the contacts 162 are designated into separate sets, where contacts 162*a* is a designated set for power, whereas designated set 162*b* is provided for signal. In the embodiment shown, positions 1 through 24, that is, designated set 162*a*, is provided for power, that is, two terminals per port for a 6×2 configuration, or 12 ports. The remainder of the contacts 162*b* are provided for signal contacts, that is, for the data contacts utilized by the modular jack contacts 60.

With respect now to FIGS. 3 and 4, a first optional configuration of the main board 14 will be described, where it relates to the inclusion of the power over ethernet board as being integrated with the overall assembly. It should first be described that main board 14 has two separate functions, the first function providing the interconnect between the modular jack terminals 60 and compliant contact portions 168. The second separate function is to provide the interface for the integrated power over ethernet card through connector member 16.

Thus, in the configuration of FIG. 4, that is, where the power over ethernet card is integrated into the connection system, the main board 14 not only provides for the path for the signal contacts 162*b*, but also provides for the path for the power through contacts 162*a* and further provides for a connection device 16, which will condition and control the power through contacts 162*b*. Thus, as shown in FIG. 4, the contact pads 180*a* on main board 14, which connect to the designated power contacts 162*a*, are also directly connected through the printed circuit board to connector 16. Meanwhile, as also shown, other throughholes on main board 14 are interconnected to signal contact portions 36*b* of shielded subassembly 12 and to power contact portions 38*b* of shielded subassembly 12.

In the case of main board 22, that is, where the board 22 is enabled for use with a power over ethernet control card, no connector 16 is required. In this case, contacts 162*b* provide the identical function as in the case of the integrated board 14, that is, providing the direct interconnect between the compliant pin portions 168 and the data contacts of the modular jacks. However, in the case of the power contacts 162*a*, while they are still interconnected to traces 180*a* on board 22, these traces 180*a* are directly interconnected to the various power contacts 38*b* of the modular jack subassemblies 12. Said differently, in the case of the enabled version of FIGS. 5 and 6, while there is a power over ethernet card, the card is located elsewhere on the overall system, for example, on the motherboard to which this overall assembly is connected. Thus, the power lines on the motherboard, which interconnect to designated power contacts 162*a*, are already controlled by the power over ethernet card. Thus, the various routings between traces 180*a* and connector 16 are not required and hence, are simply routed directly to the various power terminals 38*b*.

Finally, and in another configuration, where no power over ethernet card is required, a card similar to 22 can be provided but be slightly modified in its overall function. If no power over ethernet is required, then contacts 162*a* could be left out or could be left in for mechanical retention of the connector 18 to the board, but the throughholes to which they connect are dummy holes only for mechanical-retention purposes. In other words, in the version where no power over ethernet is required, no power is transferred through contacts 162*a*, which is accomplished by one of two ways, as described above.

In either event, that is, with either main board 14 or 22, it is preferable to provide an indication of the condition of the various ports, and for that purpose light emitting diodes (LEDs) 182 are provided on either board 14, 22 as shown in FIGS. 3 and 5. The precise function of the LEDs will be further described herein.

With respect now to FIGS. 15 through 18, the power over ethernet card is shown at 190 as including a printed circuit board 192 having a connector at 194. It should be appreciated that the connector 194 has a plurality of contacts 196, which are profiled to mate with corresponding contacts in connector 16. Furthermore, power over ethernet card 190 includes control device 198 and a plurality of active devices 200, 202.

Figure 19:
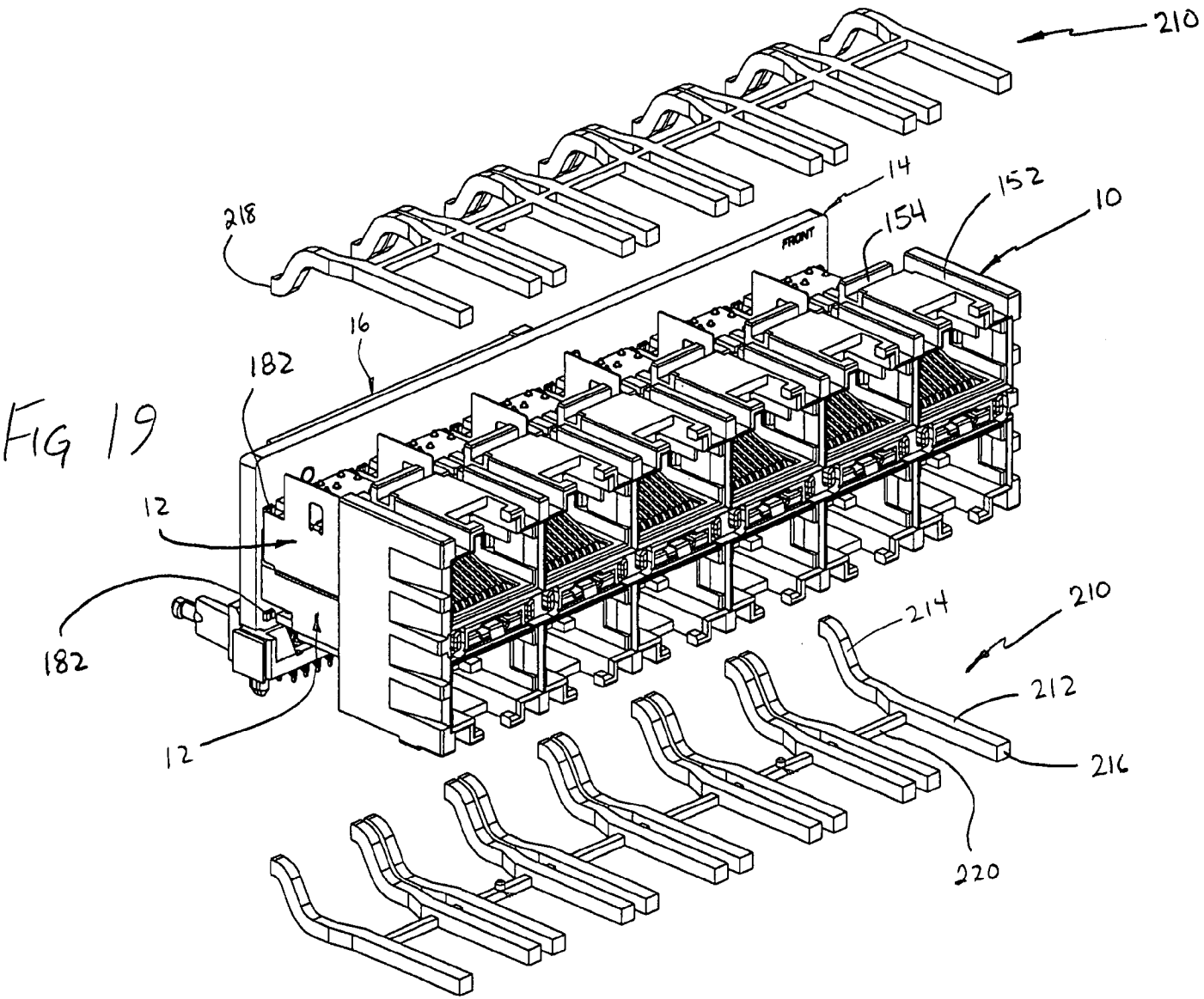
FIGS. 19–26 show progressive views of the assembly of the connector.

As shown in FIG. 19, light pipe 210 is provided, having elongate leg portions 212 and angled portions at 214 providing a front end 216 for emitting light and a rear end face at 218 for receiving light and a tie-bar member 220 therebetween. It should be appreciated that the light pipes 210 may be placed against the housing, such that elongate leg members 212 are provided in the grooves 152, and with tie bar 220 positioned in transverse groove 154, which positions end faces 218 adjacent to LEDs 182. It should also be appreciated that light pipes are comprised of a good light transmitting plastic, similar to the plastic from which fiber optic cable is made. Thus, as should be appreciated, light emitting from light emitting diodes 182 is projected onto front faces 216 of the light pipes 210.

Figure 20:
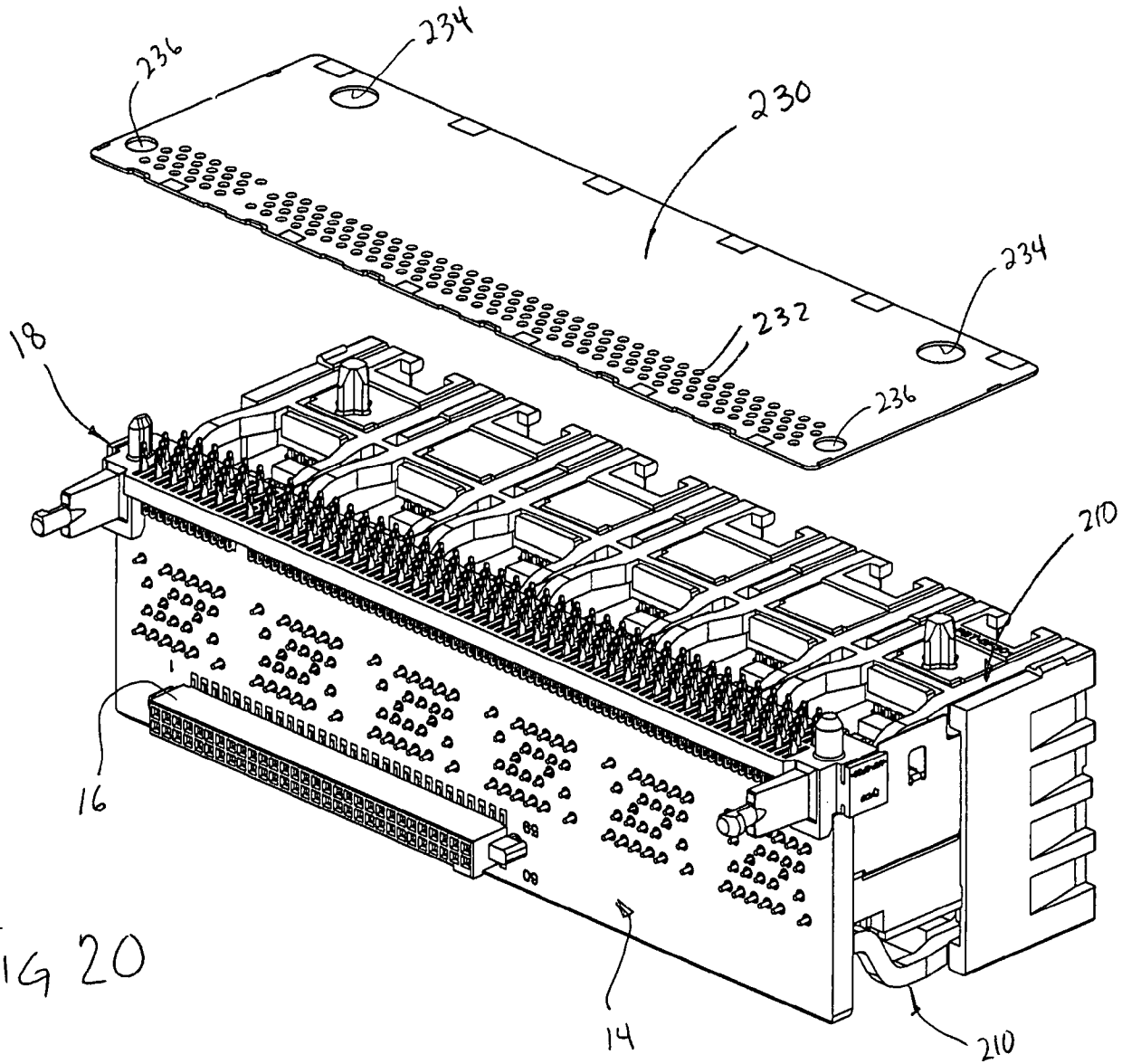

As shown in FIG. 20, light pipes 210 are shown in position in their respective grooves positioning end faces 218 adjacent to their respective LEDs 182. This provides a flush lower surface, as shown in FIG. 20, whereby tine plate 230 can be positioned over the lower surface with apertures 232 positioning the compliant pin portions of connector member 18. Tine plate 230 includes apertures 234, 236 for receipt over corresponding locating pegs on the bottom of the connector assembly, as shown in FIG. 20, which is well known in the art for locating the connector assembly relative to the motherboard.

Figure 21:
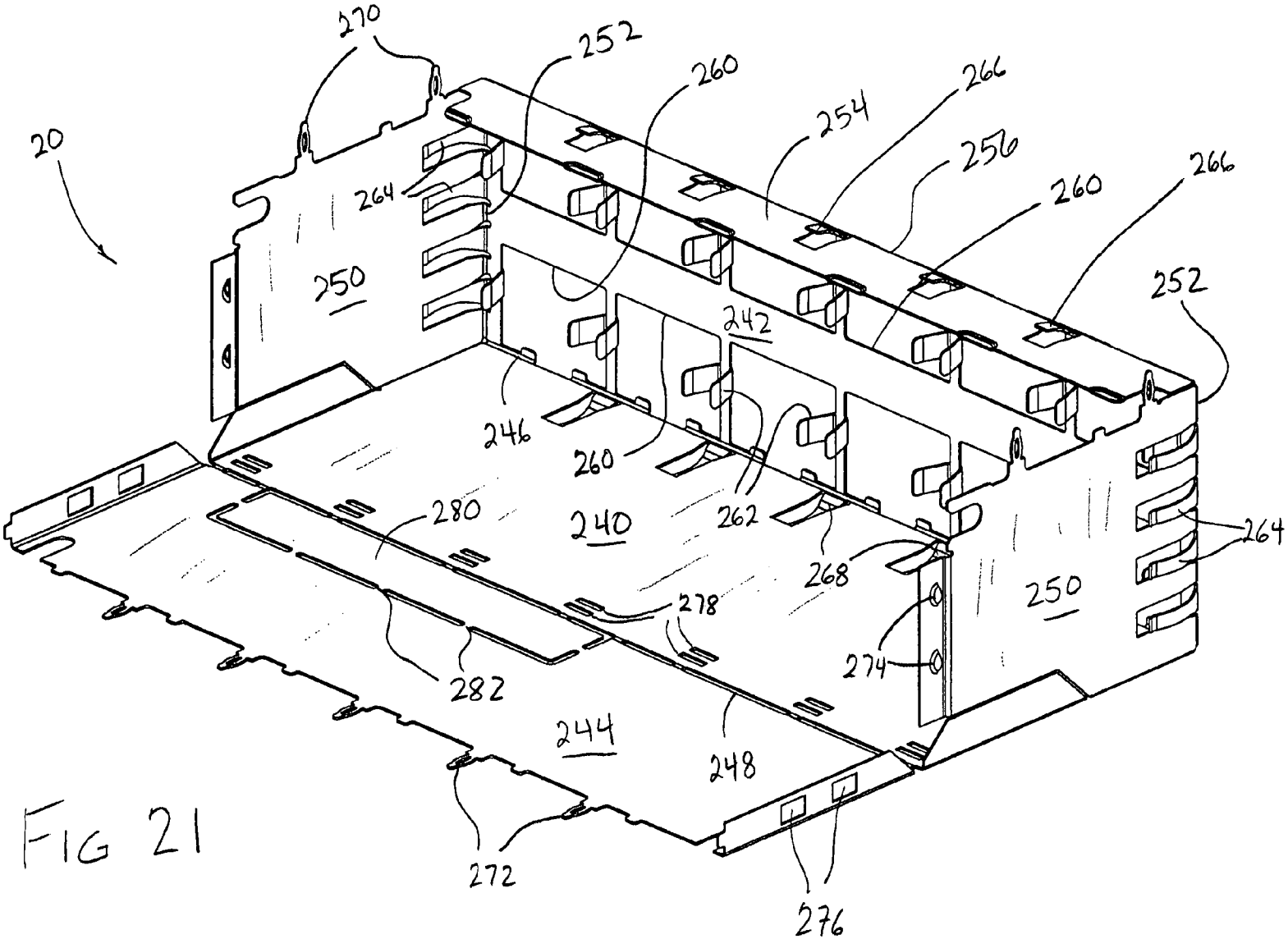

With respect now to FIG. 21, outer shield member 20 is shown, where the shield member is shown in an upside-down position resting on a top wall 240. Shield member 20 further includes a front wall 242 and a rear wall 244 extending integrally therefrom, along respective front and rear edges 246, 248. Meanwhile, side walls 250 are provided extending from side edges 252 of front wall 242. Finally, bottom wall 254 is provided integrally formed around a lower edge 256 of front wall 242.

As should be appreciated, front wall 242 includes a plurality of openings 260 appropriately positioned to be aligned with the plurality of ports defining the modular jack assembly. Each opening 260 is flanked by a pair of grounding tongues 262, which are biased inwardly so as to contact a shielded modular plug upon interconnection thereof. Side walls 250 further include grounding tongues 264, while bottom wall 254 includes grounding tongues 266 and top wall 240 includes grounding tongues 268. Side walls 250 also include grounding tines 270 and rear wall 244 includes tines 272. As is well known in the art, shield 20 includes latching detents 274 at the end edge of side walls 250, which are profiled to latch with openings 276 in rear wall 244, when rear wall 244 is rotated into position. Top wall 240 also includes pairs of connection slots 278, as will be described further herein. Finally, rear wall 244 includes a knockout portion at 280 connected to rear wall 244 only by links 282 for easy removal thereof. It should also be appreciated that the location of the knockout 280 is positioned so as to overlie connector member 16 of main board 14.

Figure 22:
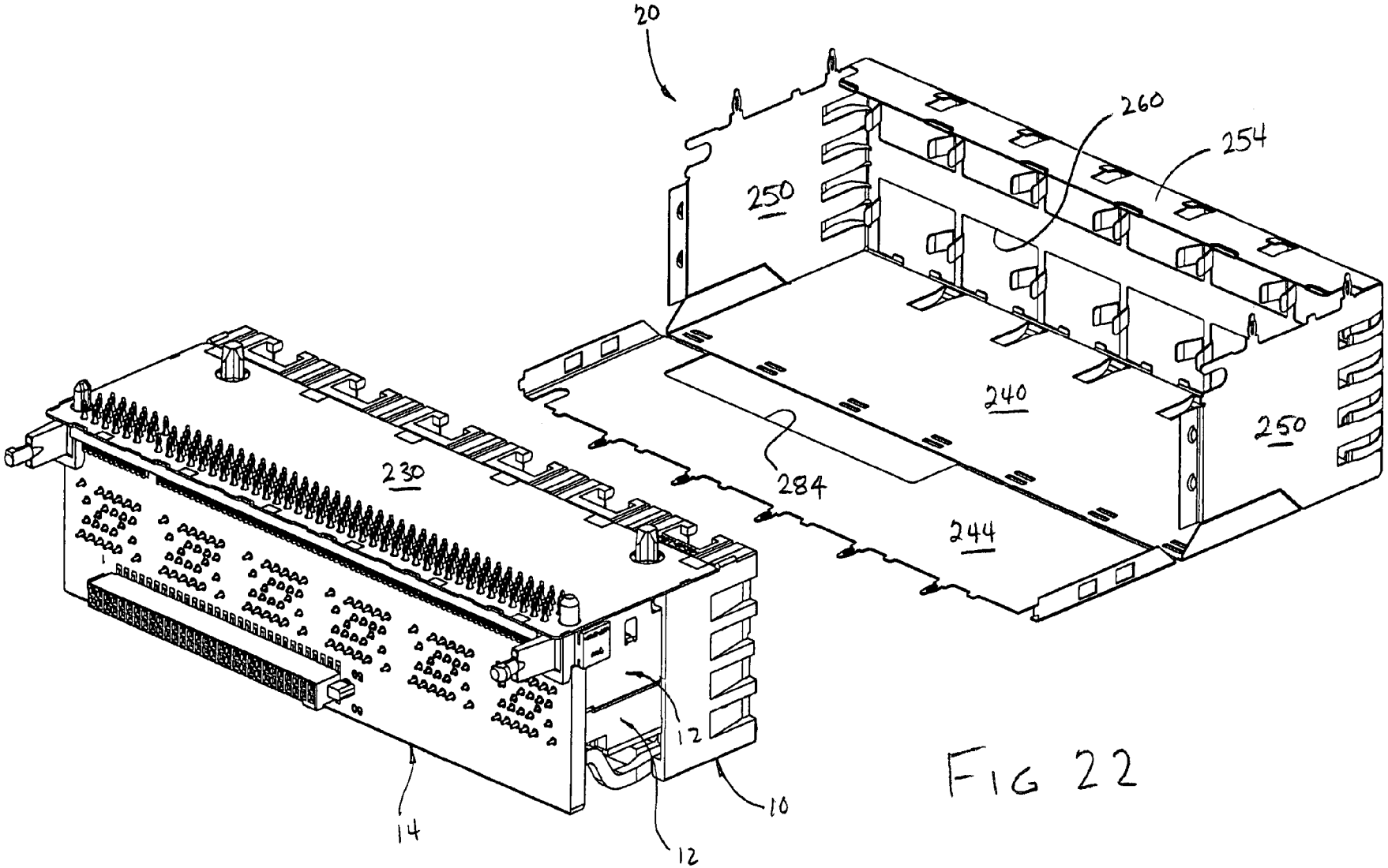
Figure 23:
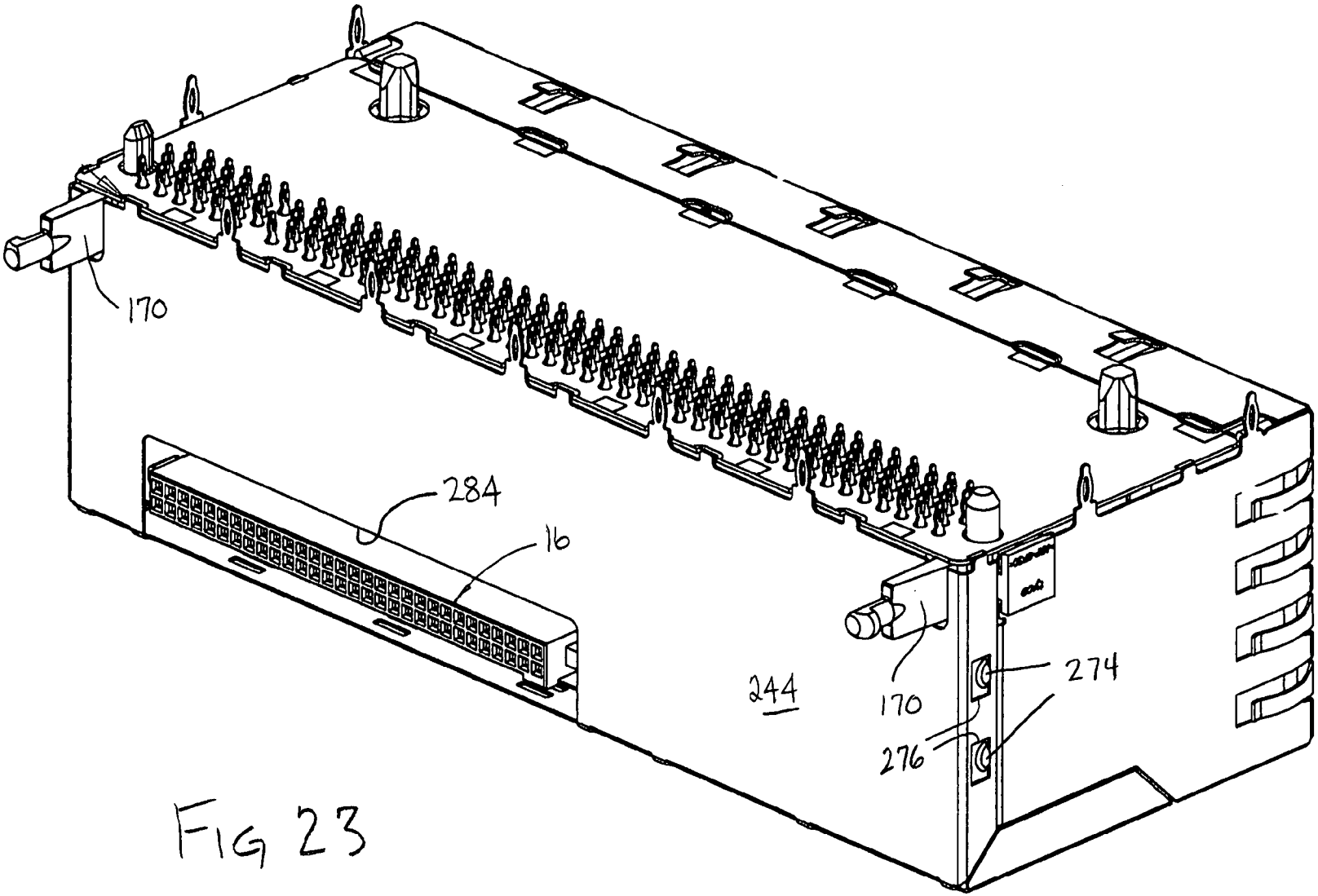

With respect now to FIG. 22, tine plate 230 is shown in the assembled position, and knockout 280 (FIG. 21) is shown removed, thereby defining opening 284. The assembly of housing 10, shielded subassembly 12 and main board 14 can thereby be slidably moved into position into shield 20 intermediate side walls 250 and beneath lower wall 254. As shown in FIG. 23, rear wall 244 is now rotated upwardly, such that apertures 276 overlap latching detents 274, which positions opening 284 over connector 16 and positions latching arms 170 exterior to rear wall 244.

Figure 24:
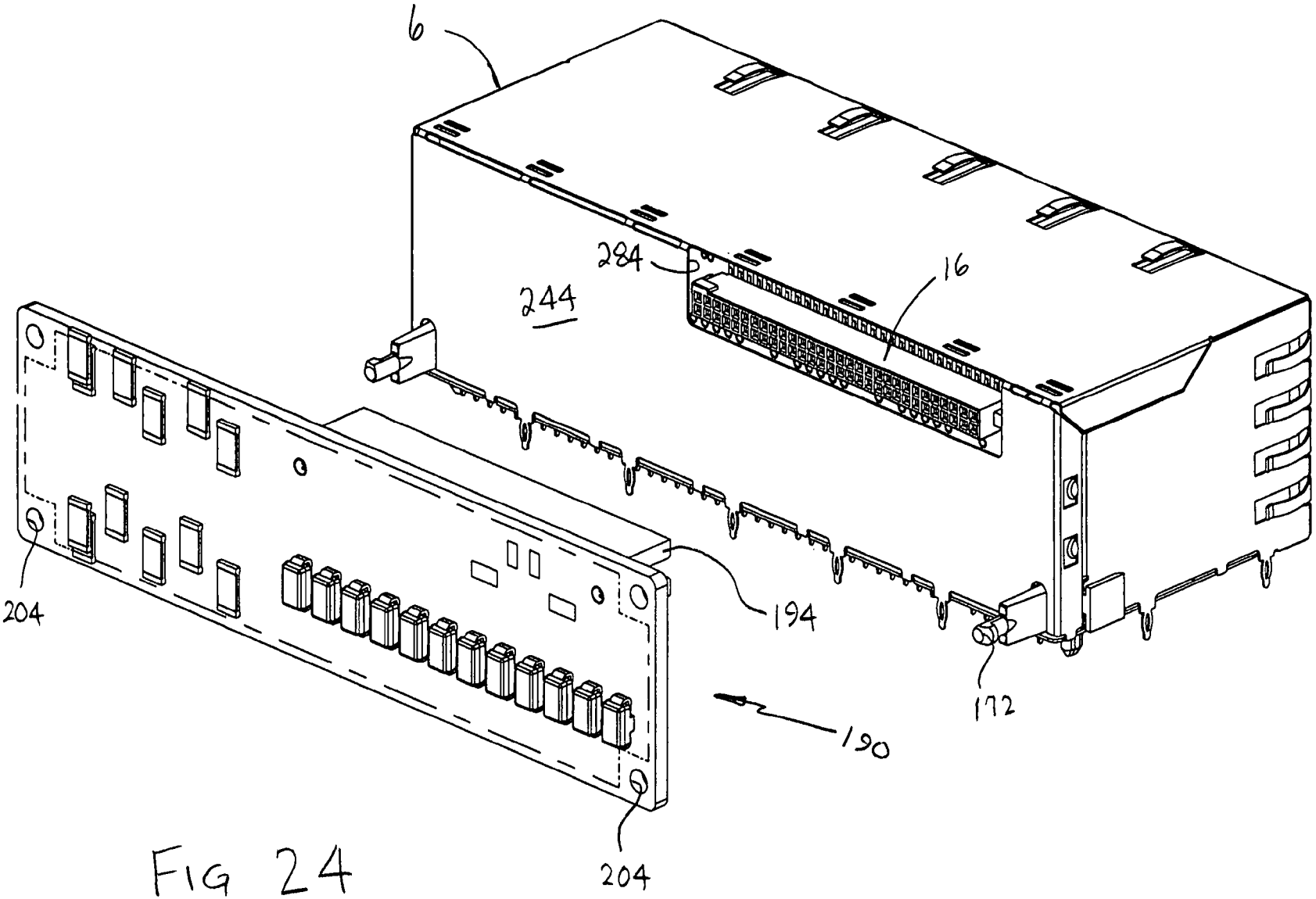
Figure 25:
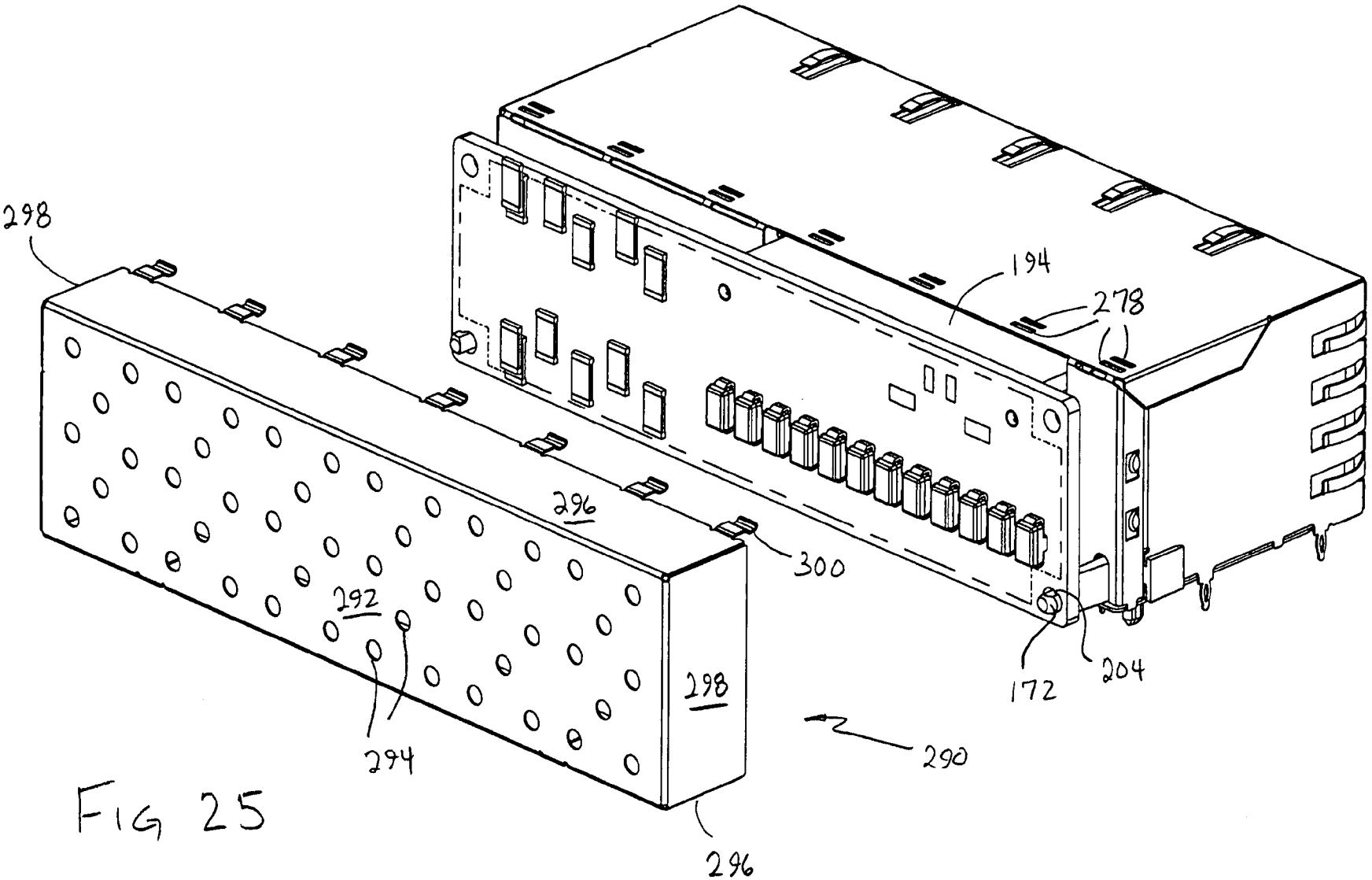
Figure 26:
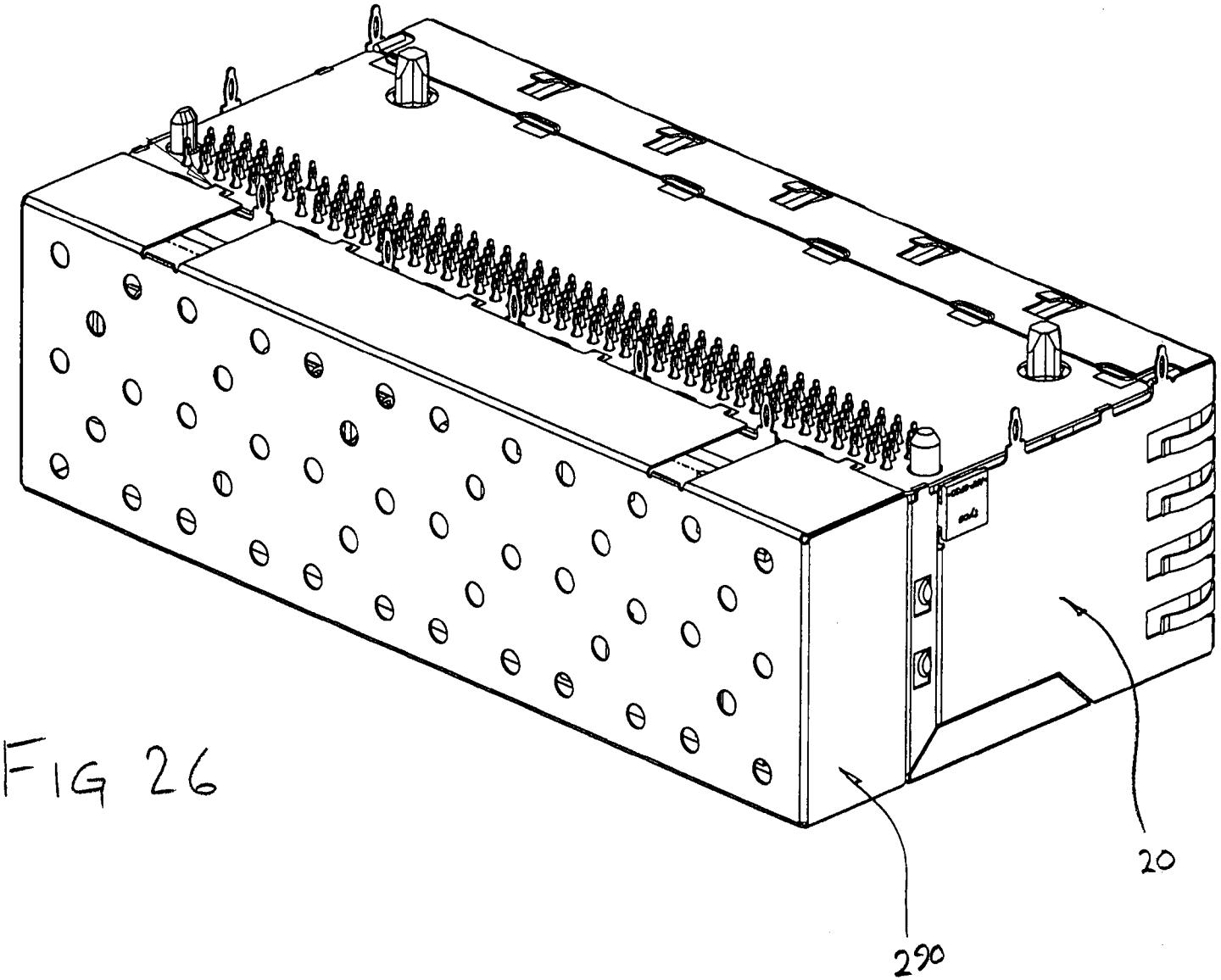

As shown in FIG. 24, power over ethernet card 190 may now be positioned adjacent to shielded assembly 6, whereby connectors 16 and 194 can be interconnected, which also provides a latching between latching lugs 172 and openings 204, as shown. As also shown in FIG. 25, rear shielded cover 290 is provided by main wall 292 having heat dissipation apertures 294, side walls 296 and end walls 298. Latching arms 300 also extend from side walls 296 and are profiled to be received in slots 278. It should be appreciated that cover 290 can be lifted and latch arms 300 rotated into slots 278 and into the position shown in FIG. 26.

Figure 27:
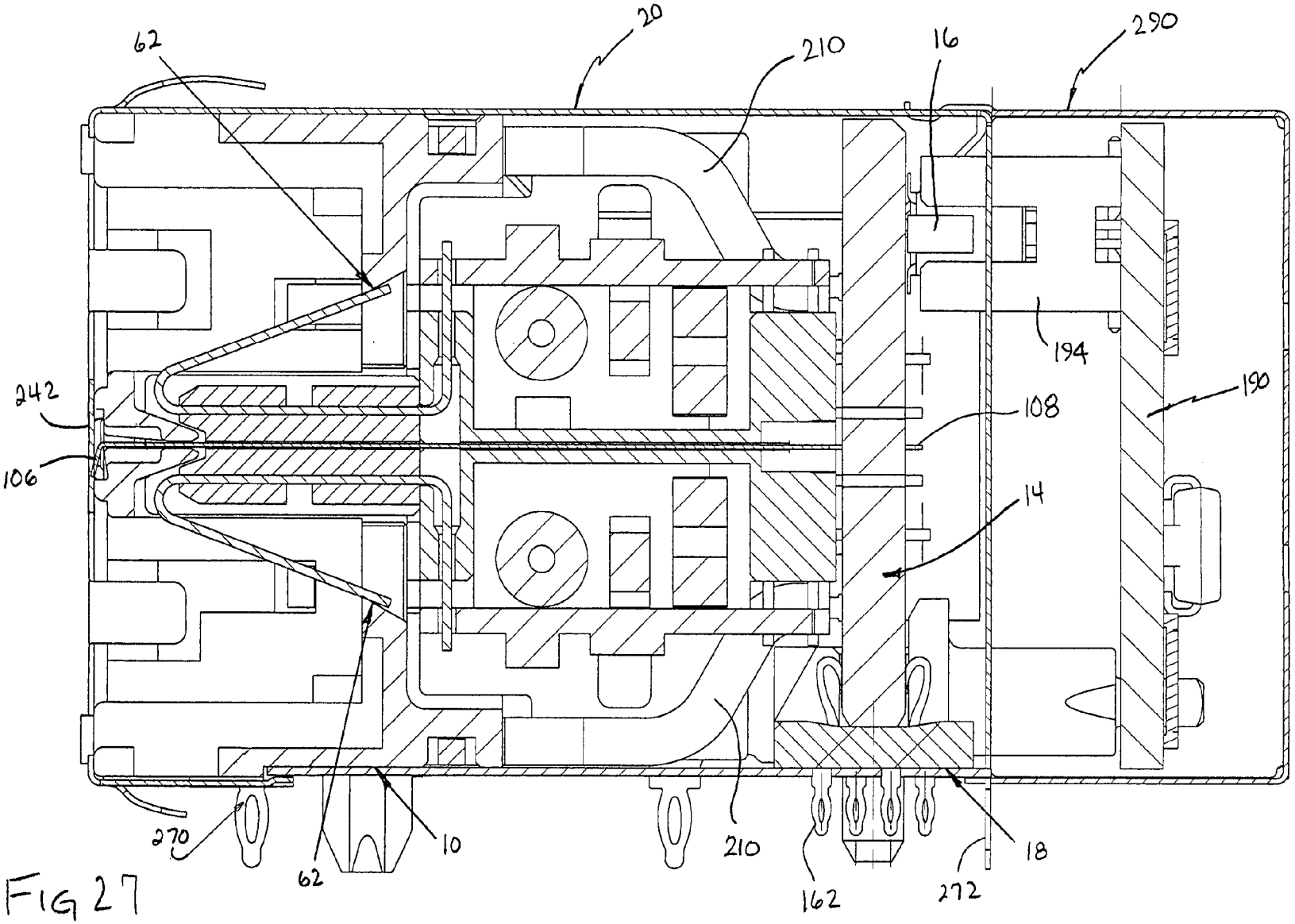
FIG. 27 shows a cross-sectional view through lines 27—27 of FIG. 1.
Figure 28:
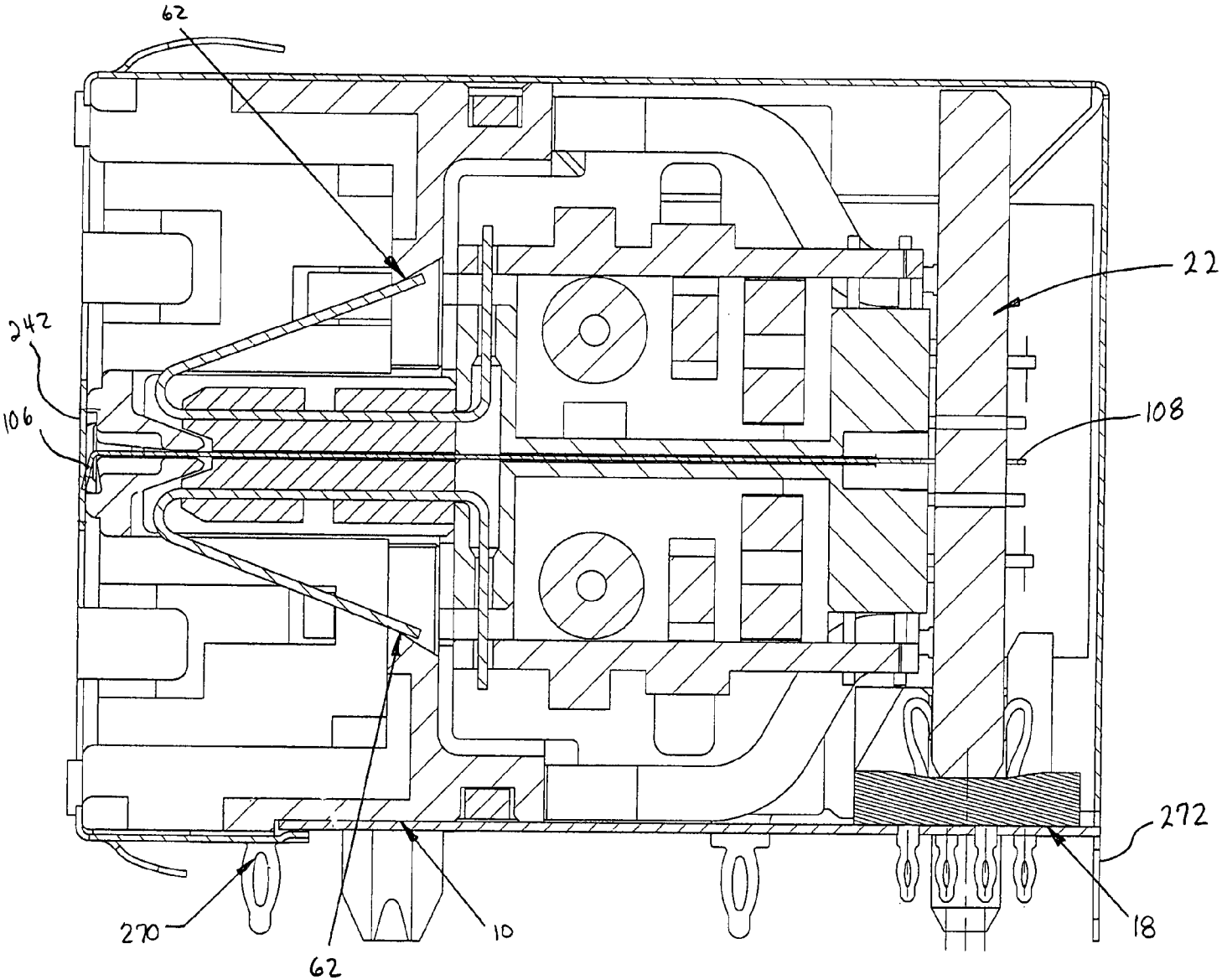
FIG. 28 is a cross-sectional view through lines 28—28 of FIG. 2.

With respect now to FIGS. 27 and 28, which are respectively cross-sectional views through lines 27—27 of FIG. 1 and lines 28—28 of FIG. 2, the internal construction of the as-assembled versions are shown. It also shows how identical constituent parts are utilized in the various assembled versions. For example, the constituent parts can provide for three different configurations of overall assembled versions. For example, main board 22 (FIG. 28) can have a first configuration, where the main board is circuit traces only, whereby the main board functions to electrically interconnect the plurality of modular jacks to a motherboard through the designated subset of traces 180*b* and contacts 162*b* (FIG. 6).

A second configuration is where main board 22 has circuit traces for electrically interconnecting the plurality of modular jack contacts 60 to the motherboard through the designated subset of terminals 162*b*. In addition, the main board 22 is enabled to receive conditioned electrical power signals for power over ethernet through another designated subset of traces 180*a* and 180*b* and terminals 162*a*.

Finally, a third configuration of the overall connection system provides for main board 14 having circuit traces for electrically interconnecting the modular jack contacts 60 to a motherboard through the designated subset of traces 180*b* and terminals 162*b* and in addition, the main board 14 provides an electrical connector 16 interconnected to the main board. A further power over ethernet conditioning board is connectable directly with connector 16, whereby the main board is adapted to receive unconditioned electrical power signals for power over ethernet through a second designated subset of terminals 162*a* and route them through the power over ethernet conditioning board and then through designated ones of the modular jack contacts 60.

Figure 29:
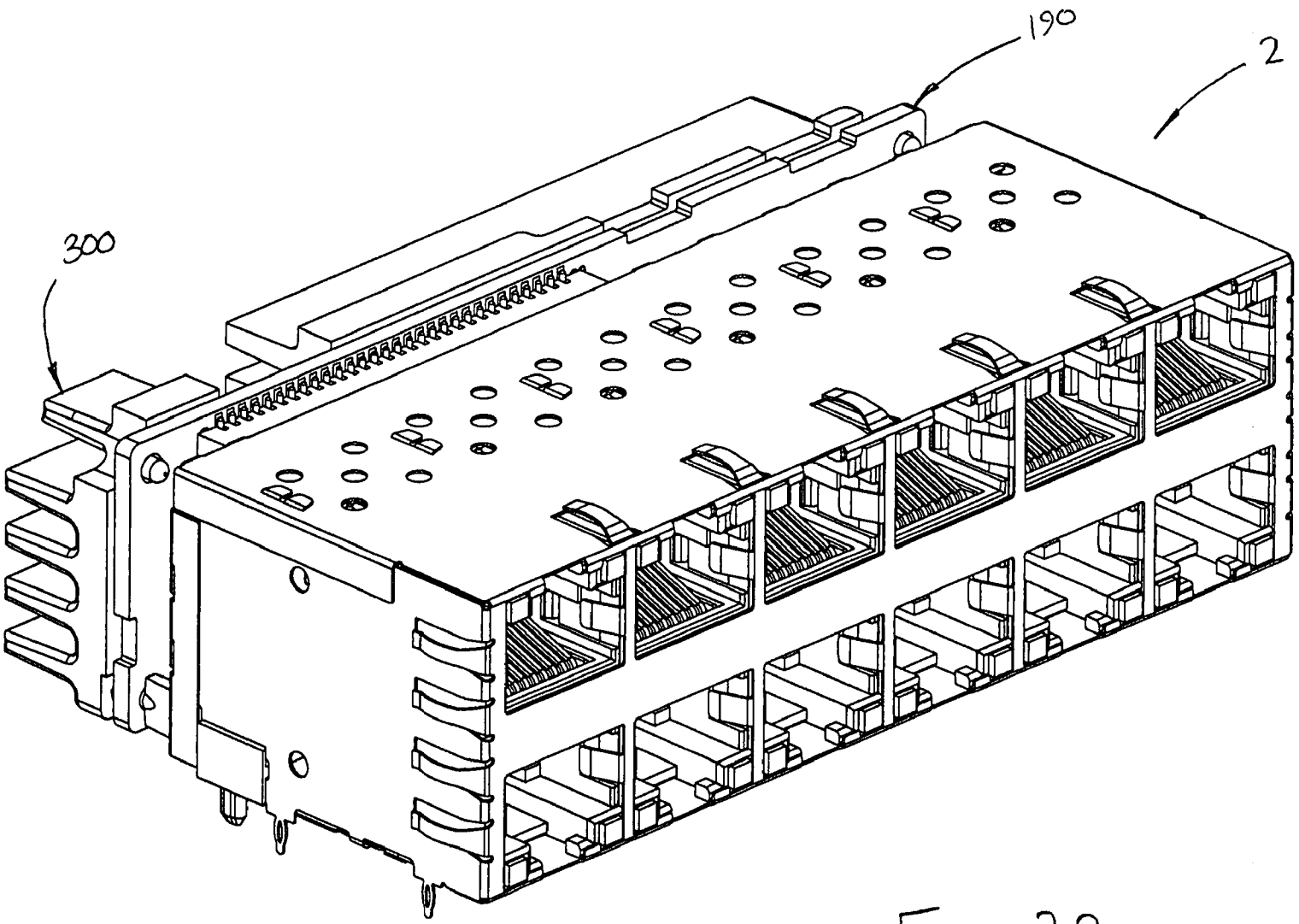
FIG. 29 shows an alternate embodiment of FIG. 1 having a heat sink connected to the power over ethernet card.
Figure 30:
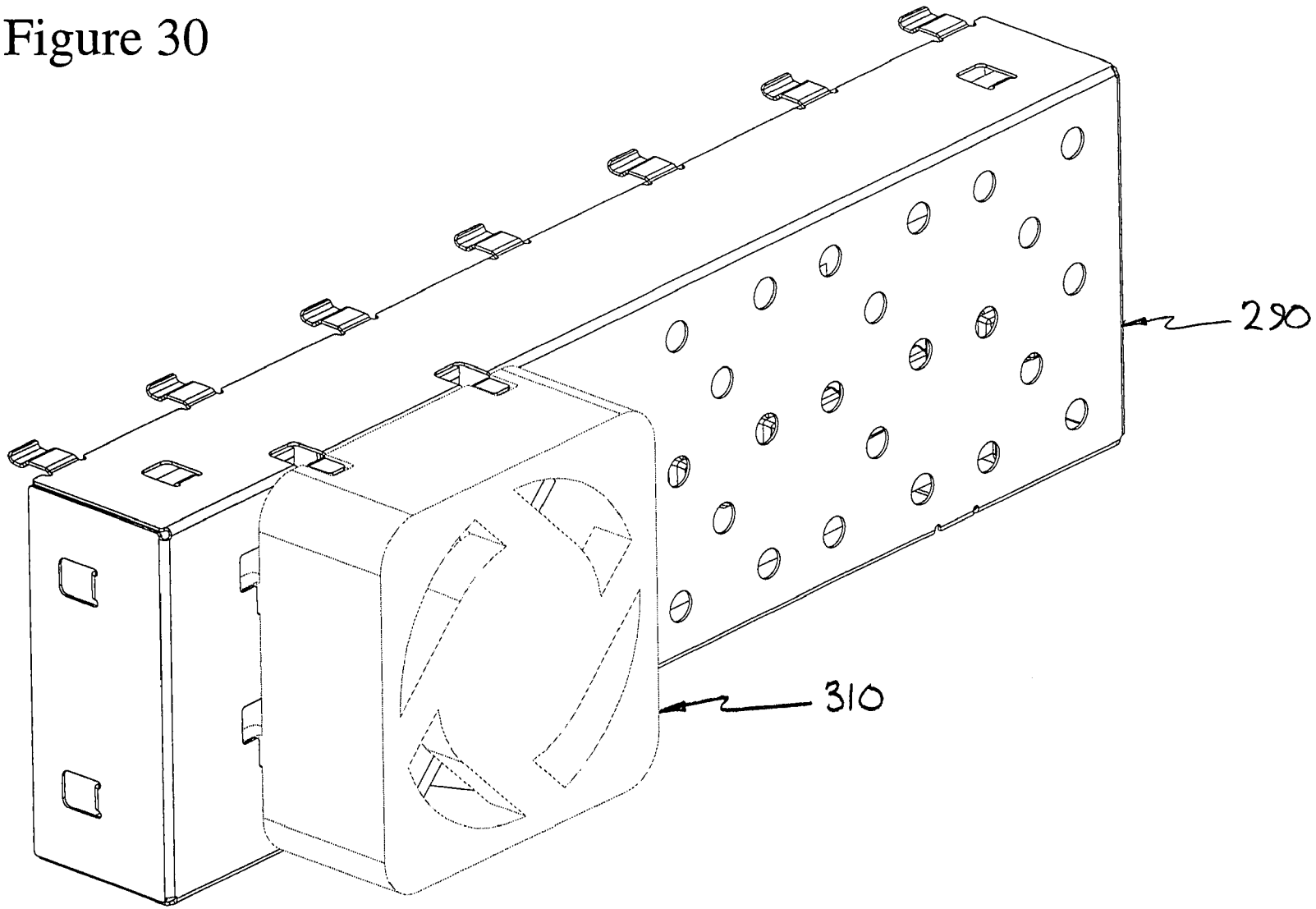
FIGS. 30 and 31 show an alternate embodiment of FIG. 29 having a fan interconnected to the power over ethernet card.
Figure 31:
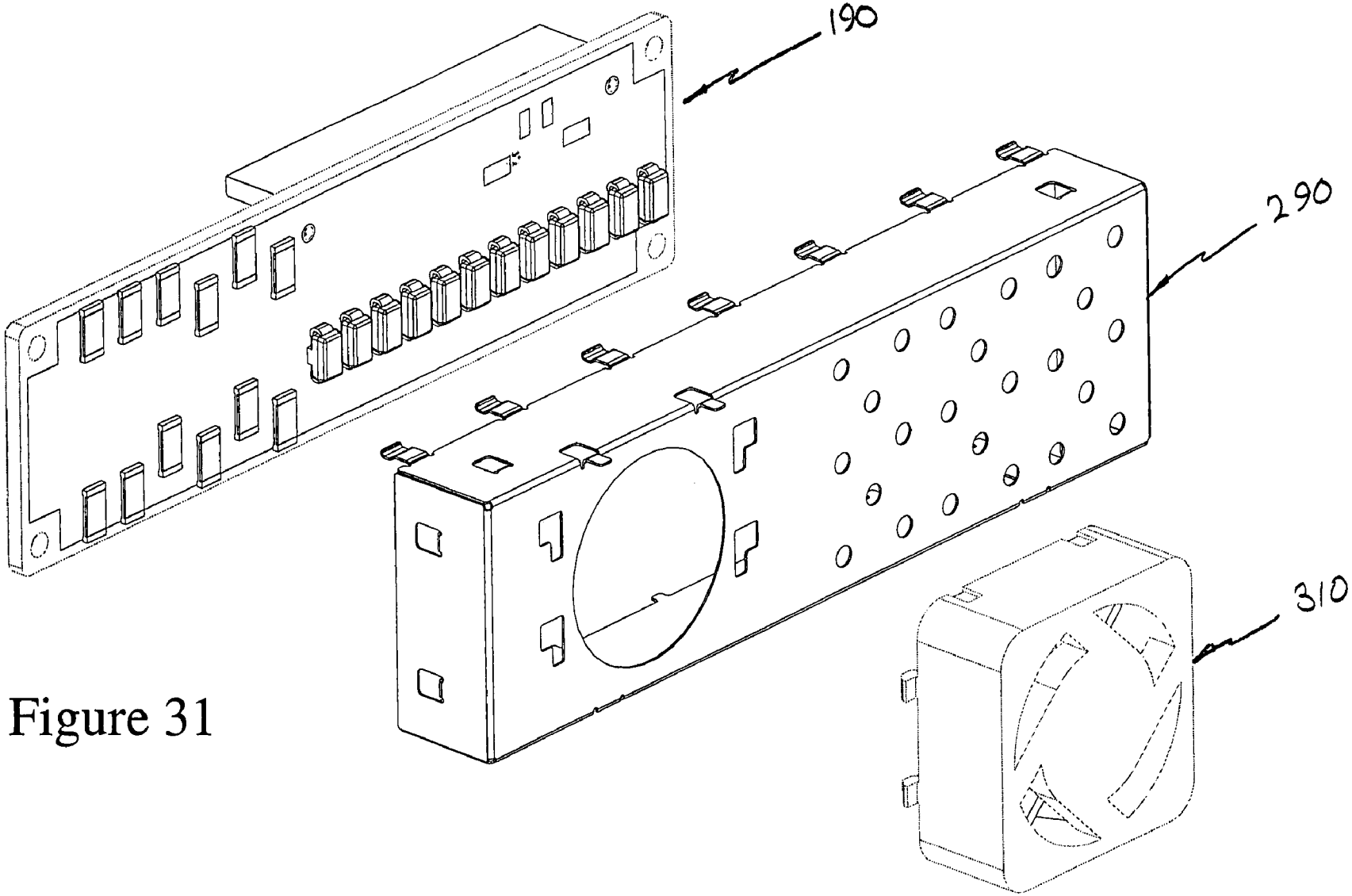

With respect now to FIGS. 29–31, heat-removal devices can be provided in the case of the integrated version, whereby a heat sink 300 can be applied to selected portions of the power over ethernet card, as shown in FIG. 29. Alternatively, as shown in FIGS. 30 and 31, a fan 310 can be applied directly to rear cover 290 to remove heat from the power over ethernet card.

What is claimed is:

1. A multi-port jack assembly having integrated power over ethernet, comprising:

a multi-port electrical connector housing having a plurality of housing ports adjacent a mating face of said connector housing;

a plurality of electrical connection devices positioned with first mating contact portions adjacent said mating face, and adapted for mating engagement with a plurality of electrical connectors in said housing ports, and a plurality of second mating contact portions extending rearwardly in a common patterned configuration;

a main board positioned adjacent to a rear of said connector housing and having a first common electrical interface, being electrically interconnected to said second mating contact portions, said main board further comprising a second common electrical interface being electrically connectable with a third common electrical interface on a motherboard, said main board having circuit traces for electrically interconnecting said plurality of electrical connection devices to said mother board through a first designated subset of said second and third common electrical interface, and said main board further comprises an electrical connector interconnected to said main board; and a power over ethernet conditioning board directly connected to said main board, whereby said main board is adapted to receive unconditioned electrical power signals for power over ethernet through a second designated subset of said second and third common electrical interface, and route them through said power over ethernet conditioning board, and then through said first mating contact portions.

2. The universal multi-port jack assembly of claim 1, further comprising an indicator member for indicating the condition of the plurality of electrical connection devices.

3. The multi-port jack assembly of claim 1, further comprising an outer shield in surrounding relation to the assembly of said connector housing, electrical connection devices and main board.

4. The multi-port jack assembly of claim 3, wherein said outer shield includes a knock-out portion overlying said position of said electrical connector, and said power over ethernet conditioning board is position outside of said shield and interconnected to said electrical connector.

5. The multi-port jack assembly of claim 4, wherein said main board lies in a vertical plane adjacent a rear of said connector housing.

6. The multi-port jack assembly of claim 5, wherein said power over ethernet card has a second electrical connector connected to said first electrical connector, with said power over ethernet card lying parallel with said main board.

7. The multi-port jack assembly of claim 1, further comprising a heat reduction device positioned on said power over ethernet card.

8. The multi-port jack assembly of claim 7, wherein said heat reduction device comprises a heat sink.

9. The multi-port jack assembly of claim 7, wherein said heat reduction device comprises a fan.

* * * * *